US008960142B2

(12) United States Patent
Toma et al.

(10) Patent No.: US 8,960,142 B2
(45) Date of Patent: Feb. 24, 2015

(54) VALVE OPENING-CLOSING TIMING CONTROL APPARATUS

(71) Applicant: Aisin Seiki Kabushiki Kaisha, Kariya-shi (JP)

(72) Inventors: Naoto Toma, Kariya (JP); Shigemitsu Suzuki, Takahama (JP); Hiroki Mukaide, Chiryu (JE); Masaki Kobayashi, Okazaki (JP); Kazuo Ueda, Gamagori (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/025,429

(22) Filed: Sep. 12, 2013

(65) Prior Publication Data

US 2014/0076254 A1 Mar. 20, 2014

(30) Foreign Application Priority Data

Sep. 18, 2012 (JP) ..... 2012-204822
Mar. 21, 2013 (JP) ..... 2013-058392

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34433* (2013.01); *F01L 2001/34456* (2013.01); *F01L 2001/34476* (2013.01)
USPC ..... 123/90.17; 123/90.15

(58) Field of Classification Search
CPC ..... F01L 1/344; F01L 1/3442; F01L 2001/34476; F01L 2001/34456; F01L 2001/34433
USPC ..... 123/90.15, 90.17, 90.31
See application file for complete search history.

(56) References Cited

U.S. PATENT DOCUMENTS

2004/0055550 A1* 3/2004 Smith ..... 123/90.17
2005/0016481 A1 1/2005 Komazawa et al.
2010/0050966 A1 3/2010 Ozawa et al.
2013/0118428 A1 5/2013 Suzuki et al.

FOREIGN PATENT DOCUMENTS

JP 11-013429 A 1/1999
JP 2004-257313 A 9/2004
JP 2010-084756 A 4/2010

OTHER PUBLICATIONS

One commonly assigned copending U.S. application discussed in accompanying information Disclosure Statement.

* cited by examiner

*Primary Examiner* — Zelalem Eshete
(74) *Attorney, Agent, or Firm* — Buchanan Ingersoll & Rooney PC

(57) ABSTRACT

A valve opening-closing timing control apparatus includes a partition portion partitioning a fluid pressure chamber into an advanced angle chamber and a retarded angle chamber, a phase control portion controlling a rotational phase of a driven-side rotational member relative to a driving-side rotational member, a lock mechanism including a lock member and a lock recess for locking the rotational phase at a predetermined phase, a lock control portion switching the lock mechanism between a locked state and an unlocked state by supplying and discharging a pressurized fluid to and from the lock recess, a phase controlling supply passage supplying the pressurized fluid to the advanced angle chamber and the retarded angle chamber, a lock controlling supply passage supplying the pressurized fluid to the lock recess, and a one-way valve blocking the pressurized fluid supplied to the lock controlling supply passage from flowing into the phase controlling supply passage.

6 Claims, 19 Drawing Sheets

VALVE OPENING-CLOSING TIMING CONTROL APPARATUS

CROSS REFERENCE TO RELATED APPLICATIONS

This application is based on and claims priority under 35 U.S.C. §119 to Japanese Patent Application 2012-204822, filed on Sep. 18, 2012, and to Japanese Patent Application 2013-058392, filed on Mar. 21, 2013, the entire content of which are incorporated herein by reference.

TECHNICAL FIELD

This disclosure generally relates to a valve opening-closing timing control apparatus.

BACKGROUND DISCUSSION

A valve opening-closing timing control apparatus controls a rotational phase of a driven-side rotational member relative to a driving-side rotational member by supplying and discharging a pressurized fluid to and from an advanced angle chamber and a retarded angle chamber. Furthermore, a lock control portion of the valve opening-closing timing control apparatus switches a state of the lock mechanism, which is a mechanism that locks the rotational phase of the driven-side rotational member relative to the driving-side rotational member, between a locked state and an unlocked state by supplying and discharging a pressurized fluid to and from a lock recess. In JP2004-257313A, hereinafter referred to as Reference 1, a valve opening-closing timing control apparatus that changes a rotational phase of a driven-side rotational member relative to a driving-side rotational member in an advanced angle direction or in a retarded angle direction is disclosed. Note that, the advanced angle direction refers to a direction in which volume of an advanced angle chamber increases and the retarded angle direction refers to a direction in which volume of a retarded angle chamber increases. In a state where the lock mechanism of the valve opening-closing timing control apparatus in Reference 1 is in a locked state, which is a state in which a lock member is inserted into a lock recess so that the lock member and the lock recess are engaged, the valve opening-closing timing control apparatus in Reference 1 supplies a pressurized fluid to a lock recess via a lock controlling supply passage. Accordingly, the lock mechanism is switched to an unlocked state, which is a state in which the lock member is retracted from the lock recess. Simultaneously, the pressurized fluid is supplied to the advanced chamber or the retarded angle chamber via a phase controlling supply passage so that the rotational phase is changed in the advanced angle direction or in the retarded angle direction.

In the valve opening-closing timing control apparatus of Reference 1, in a state where the pressurized fluid is supplied by a fluid pump driven by an internal combustion engine, the pressurized fluid having an appropriate flow rate, or pressure, is not discharged from the fluid pump at a time at which an engine is started. Accordingly, in JPH11-13429A, hereinafter referred to as Reference 2, a valve opening-closing timing control apparatus using a pressurized fluid stored in an accumulator is disclosed. The valve opening-closing timing control apparatus disclosed in Reference 2 may retain an appropriate fluid pressure even at the time at which the engine is started. The valve opening-closing timing control apparatus disclosed in Reference 2 supplies the pressurized fluid stored in the accumulator to an advanced angle chamber or a retarded angle chamber in order to stabilize an operation of a phase control portion to control a rotational phase at the time at which the engine is started.

Furthermore, the rotational phase of the driven-side rotational member relative to the driving-side rotational member becomes most advanced angle phase when a partition portion partitioning a fluid pressure chamber into the advanced angle chamber and the retarded angle chamber moves to a position at which volume of the advanced angle chamber becomes maximum. The rotational phase becomes most retarded angle phase when the partition portion moves to a position at which volume of the retarded angle chamber becomes maximum. In JP2010-84756A, hereinafter referred to as Reference 3, a valve opening-closing timing control apparatus for controlling opening-closing timing of an exhaust valve is disclosed. The valve opening-closing timing control apparatus disclosed in Reference 3 includes a most advanced angle lock mechanism that locks a rotational phase at the most advanced angle phase. The most advanced angle lock mechanism includes a lock member and a lock recess. The lock member is inserted into the lock recess to engage with the lock recess and is retracted from the lock recess to disengage with the lock recess. The lock member and the lock recess are configured to engage and disengage with each other only at a time at which the rotational phase is at the most advanced angle phase. Accordingly, at a time before the rotational phase reaches the most advanced angle phase, which in other words is at a time before the lock member enters the lock recess, a relative rotation between a driving-side rotation member and a driven-side rotation member is not restrained.

In the valve opening-closing timing control apparatus disclosed in Reference 1, the pressurized fluid for lock release and the pressurized fluid for phase change are simultaneously supplied. Accordingly, when the rotational phase of the driven-side rotational member relative to the driving-side rotational member is attempted to shift while each of the advanced angle chamber and the retarded angle chamber is in a state where the pressurized fluid is discharged and while the lock mechanism is retained in the unlocked state by supplying the pressurized fluid for lock release to the lock recess, the fluid pressure of the pressurized fluid for lock release may fall during a period during which the pressurized fluid for phase change is supplied to either the advanced angle chamber or to the retarded angle chamber to shift the rotational phase until the fluid pressure of the pressurized fluid supplied to either the advanced angle chamber or to the retarded angle chamber rises to a predetermined pressure. In a state where the fluid pressure of the pressurized fluid for lock release has fallen, the lock member that is retracted from the lock recess may engage again with the lock recess. In a state where the lock member is engaged again with the lock recess, the rotational phase may not be smoothly changed.

The valve opening-closing timing control apparatus disclosed in Reference 2 requires equipment of an accumulator that may store large volume of a pressurized fluid corresponding to maximum volume of the advanced angle chamber and the retarded angle chamber in order to supply the pressurized fluid stored in the accumulator to the advanced angle chamber or to the retarded angle chamber. In a case where the pressurized fluid stored in the accumulator is supplied to the lock recess in addition to the advanced angle chamber or the retarded angle chamber, the accumulator is required to contain a larger volume of the pressurized fluid. In general, such accumulator is installed as a unit on an engine body at a position close to the valve opening-closing timing control apparatus. As an alternative, the accumulator may be integrated into an engine cover in advance. As a result, an engine becomes large in size and an arrangement adjustment between other auxiliary units in an engine room may become complicated, which are considered as drawbacks.

Furthermore, in a valve opening-closing timing control apparatus equipped with an intermediate lock mechanism, when a phase is changed from an intermediate lock phase to most retarded angle phase by using the pressurized fluid stored in the accumulator, sufficient amount of the pressurized fluid may not be supplied to the intermediate lock mechanism as a result of rapid volume change in the retarded angle chamber. Without sufficient hydraulic pressure required for lock release, an unlock process may not be smooth, which is considered as a problem.

In addition, in the valve opening-closing timing control apparatus disclosed in Reference 3, the rotational phase of the driven-side rotational member relative to the driving-side rotational member may not be swiftly locked at most advanced angle phase. More specifically, on the driven-side rotational member that integrally rotates with a camshaft for opening and closing the exhaust valve, for example, an anti-torque of cams is exerted via the camshaft. In a state where the anti-torque is exerted on the driven-side rotational member such that the driven-side rotational member rotates relative to the driving-side rotational member in a direction opposite to the most advanced angle phase, a fluttering may occur at a moment at which the driven-side rotational member reaches a most advanced angle phase position. The fluttering is a rotation of the driven-side rotational member in the direction opposite to the most advanced angle phase caused by a cam torque exerted on the driven-side rotational member. When the fluttering occurs, even at a time at which the driven-side rotational member reaches the most advanced angle phase position, the lock member may lose a timing to be inserted into the lock recess. Accordingly, the lock member may not be swiftly locked at the most advanced angle phase. Such fluttering may similarly occur in a valve opening-closing timing control apparatus equipped with a most retarded angle lock mechanism including a lock member and a lock recess, the lock member and the lock recess that engage with each other when the lock member is inserted into the lock recess and disengage with each other when the lock member is retracted from the lock recess only at a time at which the rotational phase is at the most retarded angle phase.

A need thus exists for a valve opening-closing timing control apparatus, which is not susceptible to the drawbacks mentioned above.

SUMMARY

A valve opening-closing timing control apparatus includes a driving-side rotational member synchronously rotating with a crankshaft of an internal combustion engine, a driven-side rotational member arranged to share a rotational axis with the driving-side rotational member and integrally rotating with a camshaft for opening and closing a valve of the internal combustion engine, a partition portion arranged on at least one of the driving-side rotational member and the driven-side rotational member, the partition portion partitioning a fluid pressure chamber formed between the driving-side rotational member and the driven-side rotational member into an advanced angle chamber and a retarded angle chamber, a phase control portion controlling a rotational phase of the driven-side rotational member relative to the driving-side rotational member by supplying and discharging a pressurized fluid to and from the advanced angle chamber and the retarded angle chamber, a lock mechanism configured to lock the rotational phase at a predetermined phase, the lock mechanism including a lock member positioned at one of the driving-side rotational member and the driven-side rotational member and a lock recess positioned at the other one of the driving-side rotational member and the driven-side rotational member, the lock member and the lock recess engaging with each other when the lock member is inserted into the lock recess and disengaging with each other when the lock member is retracted from the lock recess, a lock control portion switching a state of the lock mechanism between a locked state and an unlocked state by supplying and discharging the pressurized fluid to and from the lock recess, a phase controlling supply passage supplying the pressurized fluid to the advanced angle chamber and the retarded angle chamber, a lock controlling supply passage supplying the pressurized fluid to the lock recess, and a one-way valve blocking the pressurized fluid supplied to the lock controlling supply passage from flowing into the phase controlling supply passage.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
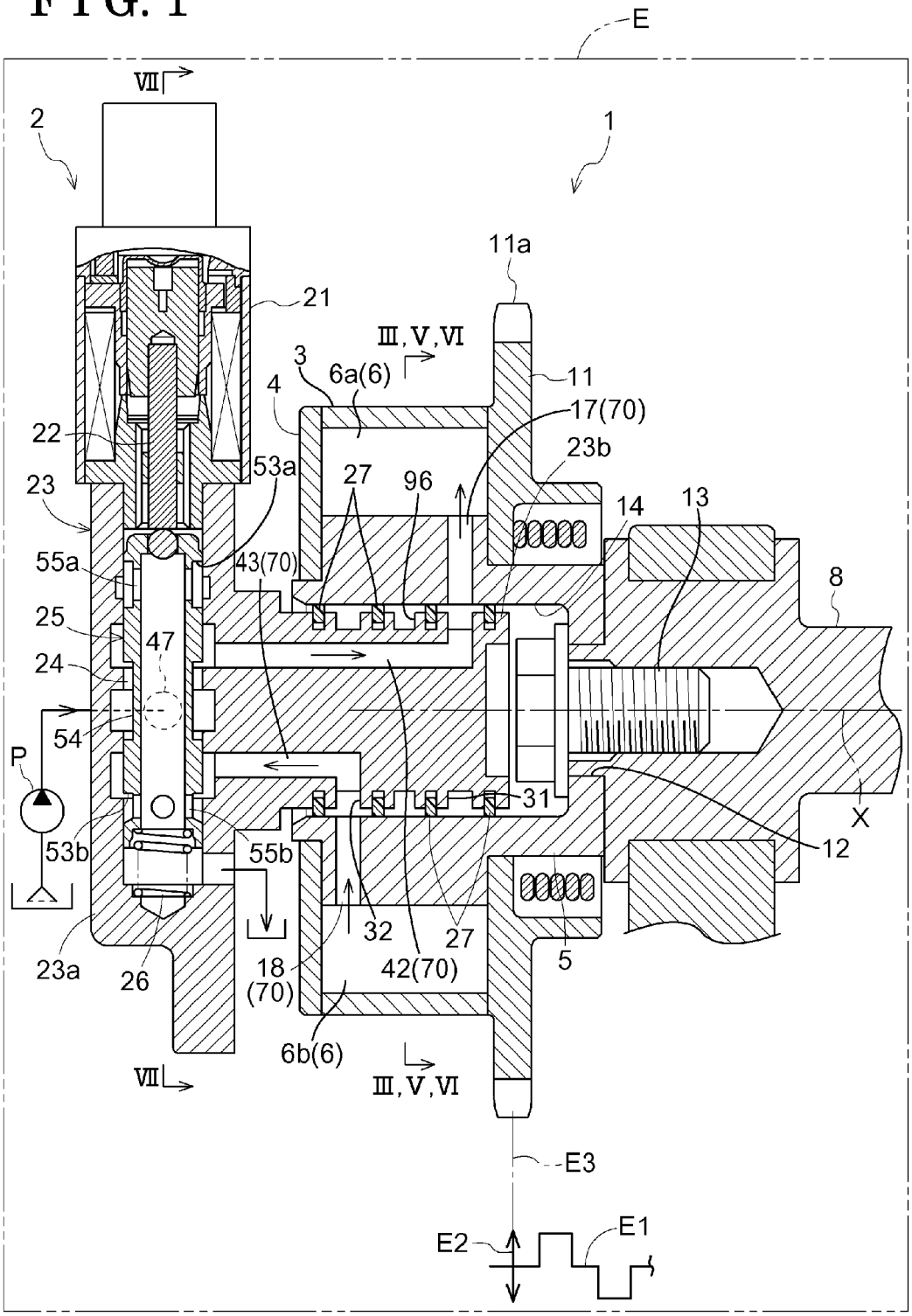
FIG. 1 is a cross-sectional view drawing conforming to a rotational axis of a first embodiment of a valve opening-closing timing control apparatus illustrating the first embodiment of the valve opening-closing timing control apparatus taken at a fluid control valve portion.

A valve opening-closing timing control apparatus 1 according to a first embodiment will be described referring to drawings. An overall configuration of the first embodiment will be described first. FIGS. 1 to 11 illustrates the valve opening-closing timing control apparatus 1 according to the first embodiment. The valve opening-closing timing control apparatus 1 includes an outer rotor 3, which serves as a driving-side rotational member, synchronously rotating with a crankshaft E1 of an engine E for an automobile. The engine E serves as an internal combustion engine. The valve opening-closing timing control apparatus 1 further includes an inner rotor 5, which serves as a driven-side rotational member, coaxially arranged with the outer rotor 3. More specifically, the inner rotor 5 is arranged to share a rotational axis X with the outer rotor 3. The inner rotor 5 integrally rotates with a camshaft 8 for opening and closing valves of the engine E. Furthermore, the valve opening-closing timing control apparatus 1 includes an oil pump P, which serves as a fluid pump. The oil pump P discharges an operation oil, which is an engine oil. Note that, an operation oil serves as a pressurized fluid. The valve opening-closing timing control apparatus 1 according to the first embodiment controls opening-closing timing of intake valves.

The inner rotor 5 is integrally installed at an end portion of the camshaft 8 that serves as a rotational shaft for cams that operate to open and close the intake valves of the engine E. The inner rotor 5 is provided with a recess portion 14 at a radially inward position of the inner rotor 5. A retaining through-hole 12 extends between a bottom surface of the recess portion 14 to a surface of the inner rotor 5 in a direction of the camshaft 8. A bolt 13 is inserted through the retaining through-hole 12 to retain the inner rotor 5 to the camshaft 8. The camshaft 8 is rotationally supported to a cylinder head of the engine E.

The outer rotor 3 is arranged between a front plate 4 arranged at a position in a frontward direction of the outer rotor 3 and a rear plate 11 arranged at a position in a rearward direction of the outer rotor 3. The outer rotor 3, the front plate 4, and the rear plate 11 are connected by bolts 3*a* to form an integral unit. The outer rotor 3 is arranged outward of the inner rotor 5 in a state in which the outer rotor 3 rotates relative to the inner rotor 5 within a predetermined angle range. A sprocket portion 11*a* is formed at an outer peripheral portion of the rear plate 11. A power transmission member E3, for example a timing chain or a timing belt, is entrained around the sprocket portion 11*a* and sprockets E2 attached to the crankshaft E1.

When the crankshaft E1 is driven to rotate, a rotational motive power is transmitted to the sprocket portion 11*a* via the power transmission member E3 so that the outer rotor 3 is driven to rotate in a direction indicated with an arrow S. When the outer rotor 3 is driven to rotate, the inner rotor 5 is driven to rotate so that the camshaft 8 rotates, which in turn makes the cams equipped on the camshaft 8 push down the intake valves of the engine E to open the intake valves.

As FIGS. 3 to 6 illustrates, a multiple number of protrusions protruding inwardly in a radial direction is formed on the outer rotor 3. The protrusions are formed at intervals in a direction conforming to a rotational direction of the outer rotor 3. Accordingly, four fluid pressure chambers 6 are formed between the outer rotor 3 and the inner rotor 5 partitioned by the protrusions.

At an outer peripheral portion of the inner rotor 5, at portions facing the fluid pressure chambers 6, grooves are formed. Into each groove, a vane 7, which serves as a partition portion, is inserted. Each fluid chamber 6 is partitioned by the vane 7 in a rotational direction of the inner rotor 5 into an advanced angle chamber 6*a* and a retarded angle chamber 6*b*.

The inner rotor 5 is formed with an advanced angle chamber communication through-hole 17 and a retarded angle chamber communication through-hole 18. The advanced angle chamber communication through-hole 17 communicates between a recess portion 14 and the advanced angle chamber 6*a*. The retarded angle chamber communication through-hole 18 communicates between the recess portion 14 and the retarded angle chamber 6*b*.

In order to control a rotational phase of the inner rotor 5 relative to the outer rotor 3 to either shift in an advanced angle direction or in a retarded angle direction, a fluid control valve portion 2, which serves as a phase control portion, is provided. The operation oil discharged from the oil pump P is supplied to and discharged from the advanced angle chamber 6*a* and the retarded angle chamber 6*b* to shift the rotational phase. Note that, the advanced angle direction is a direction indicated with an arrow S1, which is a direction that makes volume of the advanced angle chamber 6*a* increase. The retarded angle direction is a direction indicated with an arrow S2, which is a direction that makes volume of the retarded angle chamber 6*b* increase.

In a state where the operation oil is supplied to the advanced angle chamber 6*a*, the rotational phase shifts in the advanced angle direction S1. In a state where the operation oil is supplied to the retarded angle chamber 6*b*, the rotational phase shifts in the retarded angle direction S2. An angle range in which the rotational phase of the inner rotor 5 may shift relative to the outer rotor 3 is determined by an angle range in which the vane 7 may displace within the fluid pressure chamber 6, which is a range between most retarded angle phase and most advanced angle phase. The most retarded angle phase is a phase at which the volume of the retarded angle chamber 6*b* becomes maximum. The most advanced angle phase is a phase at which the volume of the advanced angle chamber 6*a* becomes maximum.

The phase control portion of the valve opening-closing timing control apparatus 1 according to the first embodiment will be described next. The phase control portion is configured with the fluid control valve portion 2. The fluid control valve portion 2 selectively operates an advanced angle control and a retarded angle control. In the advanced angle control, the operation oil is supplied to the advanced angle chamber 6*a* to shift the rotational phase of the inner rotor 5 relative to the outer rotor 3 in the advanced angle direction S1. In the retarded angle control, the operation oil is supplied to the retarded angle chamber 6*b* to shift the rotational phase of the inner rotor 5 relative to the outer rotor 3 in the retarded angle direction S2.

The fluid control valve portion 2, which serves as the phase control portion, controls the rotational phase of the inner rotor 5 relative to the outer rotor 3 by supplying and discharging the operation oil that is discharged from the oil pump P to and from the advanced angle chamber 6*a* or the retarded angle chamber 6*b*. The fluid control valve portion 2 is attached to the recess portion 14 of the inner rotor 5 in a state in which the fluid control valve portion 2 may rotate relative to the recess portion 14. Furthermore, the fluid control valve portion 2 is fixed to a non-moving portion, for example a front cover of the engine E. In other words, the fluid control valve portion 2 remains still and does not rotate along with rotation of the inner rotor 5.

Figure 7:
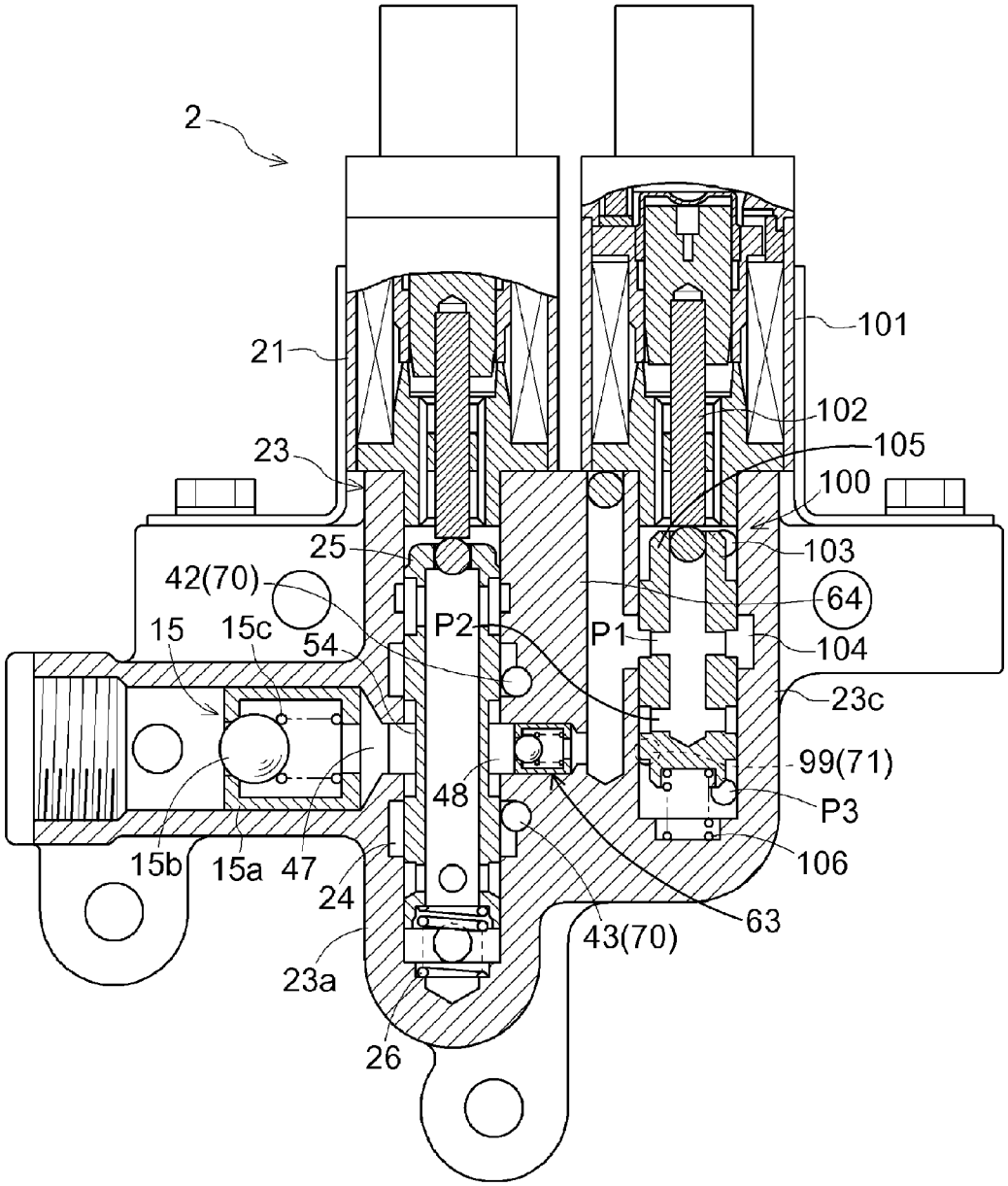
FIG. 7 is a cross-sectional view drawing of the first embodiment of the valve opening-closing timing control apparatus taken along line VII-VII in FIGS. 1 and 2.

The fluid control valve portion 2 includes a solenoid 21, a housing 23, and a spool 25, which is hollow, as FIGS. 1 and 7 illustrate. The spool 25 is formed in a hollow cylinder form having a bottom. The housing 23 includes a first spool housing portion 23*a* and a protruding portion 23*b* that is inserted into the recess portion 14.

The first spool housing portion 23*a* is formed with a hollow portion 24 to house, or to contain, the spool 25. The hollow portion 24 is formed in a hollow cylinder form having an opening in one direction and a bottom. The protruding portion 23*b* is formed in a solid cylinder form having a form corresponding to the recess portion 14. The hollow portion 24 of the first spool housing portion 23*a* and the protruding portion 23*b* are arranged to extend perpendicular to each other. The spool 25 is housed in the hollow portion 24 such that the spool 25 is linearly movable in a direction perpendicular to the rotational axis X of the camshaft 8.

As FIG. 1 illustrates, the protruding portion 23*b* is inserted into the recess portion 14 of the inner rotor 5 such that the protruding portion 23*b* may rotate relative to the recess portion 14 of the inner rotor 5. At the same time, the housing 23 is fixed, for example, to the front cover of the engine E. Accordingly, the inner rotor 5 is rotatably supported to the protruding portion 23*b* so that the inner rotor 5 may rotate relative to the protruding portion 23*b*.

A spring 26 is arranged to span between the spool 25 and a bottom surface of the hollow portion 24. Accordingly, the spool 25 is biased in a direction toward the opening of the hollow portion 24. The solenoid 21 is arranged at an open end portion of the first spool housing portion 23*a*. The solenoid 21 makes the spool 25 reciprocate in the direction perpendicular to the rotational axis X of the camshaft 8. A rod 22 of the solenoid 21, the rod 22 that comes out of and retracts into the solenoid 21, is arranged such that the rod 22 makes contact with a bottom portion of the spool 25.

In a state where the solenoid 21 is supplied with electricity, the rod 22 moves in a direction to protrude from the solenoid 21 and pushes the bottom portion of the spool 25 so that the spool 25 moves in a downward direction in FIG. 1. In a state where supply of electricity to the solenoid 21 is cut off, the rod 22 moves in a direction to retract into the solenoid 21. Accordingly, biased by a biasing force of the spring 26, the spool 25 moves in the direction toward the solenoid 21 along with movement of the rod 22. Note that, a configuration of the fluid control valve portion 2 includes, for example, the solenoid 21, the rod 22, the spool 25, and the spring 26.

On an outer circumferential surface of the protruding portion 23*b*, four circumferential grooves, each of which is an annular groove, are formed at positions parallel to each other. Each of the circumferential grooves is provided with a seal ring 27 to prevent the operation oil from leaking. Between the circumferential grooves next to each other, an outer circumferential groove 31 for advanced angle, an outer circumferential groove 32 for retarded angle, and an outer circumferential groove 96 for lock operation are formed. The outer circumferential groove 96 for lock operation is formed at a position between the outer circumferential groove 31 for advanced angle and the outer circumferential groove 32 for retarded angle. Each of the seal rings 27 prevents leaking of the operation oil from the outer circumferential groove 31 for advanced angle, the outer circumferential groove 32 for retarded angle, and the outer circumferential groove 96 for lock operation.

Inside the protruding portion 23*b*, an advanced angle direction passage 42, a retarded angle direction passage 43 and a lock passage 99 are formed. The advanced angle direction passage 42 communicates with the outer circumferential groove 31 for advanced angle. The retarded angle direction passage 43 communicates with the outer circumferential groove 32 for retarded angle. The lock passage 99 communicates with the outer circumferential groove 96 for lock operation. The advanced angle chamber 6*a* communicates with the outer circumferential groove 31 for advanced angle via the advanced angle chamber communication through-hole 17 at all time. The retarded angle chamber 6*b* communicates with the outer circumferential groove 32 for retarded angle via the retarded angle chamber communication through-hole 18 at all time. Furthermore, a bottom portion of an intermediate lock recess 93, which will be described later, communicates with the outer circumferential groove 96 for lock operation via an intermediate lock passage 95 at all time. In addition, a bottom portion of a most retarded angle lock recess 60, which will be described later, communicates with the outer circumferential groove 96 for lock operation via a most retarded angle lock passage 61 at all time.

As FIGS. 1 and 7 illustrate, the first spool housing portion 23*a* is formed with a supply-side passage 47 formed to extend in a direction that conforms to a direction perpendicular to the spool 25. One end of the supply-side passage 47 communicates with the hollow portion 24 of the first spool housing portion 23*a*. From the other end of the supply-side passage 47, the operation oil from the oil pump P is supplied.

As FIG. 7 illustrates, in an intermediate portion of the supply-side passage 47, a first check valve 15 for blocking, or preventing, the operation oil supplied to the hollow portion 24 of the first spool housing portion 23*a* from flowing in a reverse direction toward the oil pump P. The first check valve 15 includes a sleeve 15*a* that is internally fit to the supply-side passage 47, a spherical valve body 15*b* attached to an internal space of the sleeve 15*a*, and a spring 15*c* that biases the spherical valve body 15*b* toward an upstream direction of the supply-side passage 47.

One open end of the advanced angle direction passage 42 connects to the hollow portion 24. In addition, the other open end of the advanced angle direction passage 42 connects to the outer circumferential groove 31 for advanced angle. One open end of the retarded angle direction passage 43 connects to the hollow portion 24. In addition, the other open end of the retarded angle direction passage 43 connects to the outer circumferential groove 32 for retarded angle.

On an outer circumferential surface of the spool 25, as FIG. 1 illustrates, an outer circumferential groove 53*a* for discharging fluid, an outer circumferential groove 53*b* for discharging fluid, and an outer circumferential groove 54 for supplying fluid are formed. Each of the outer circumferential groove 53*a* for discharging fluid, the outer circumferential groove 53*b* for discharging fluid, and the outer circumferential groove 54 for supplying fluid is an annular groove. The outer circumferential groove 53*a* for discharging fluid is provided with a through-hole 55*a* that communicates with the hollow portion 24. The outer circumferential groove 53*b* for discharging fluid is provided with a through-hole 55*b* that communicates with the hollow portion 24.

A positional relationship between the outer circumferential groove 53*a* for discharging fluid, the outer circumferential groove 53*b* for discharging fluid, and the outer circumferential groove 54 for supplying fluid will be described next. As FIG. 1 illustrates, in a state where the solenoid 21 is not supplied with electricity, the outer circumferential groove 54 for supplying fluid communicates with the supply-side passage 47 and the advanced angle direction passage 42. At the same time, the outer circumferential groove 53*b* for discharging fluid communicates with the retarded angle direction passage 43. In a state in which the solenoid 21 is supplied with electricity, the outer circumferential groove 54 for supplying fluid communicates with the supply-side passage 47 and the retarded angle direction passage 43. At the same time, the outer circumferential groove 53*a* for discharging fluid communicates with the advanced angle direction passage 42. A phase controlling supply passage 70 supplies the operation oil to the advanced angle chamber 6*a* and the retarded angle chamber 6*b*. The phase controlling supply passage 70 is configured with the advanced angle chamber communication through-hole 17 and the advanced angle direction passage 42. Furthermore, the phase controlling supply passage 70 is configured with the retarded angle chamber communication through-hole 18 and the retarded angle direction passage 43.

Figure 3:
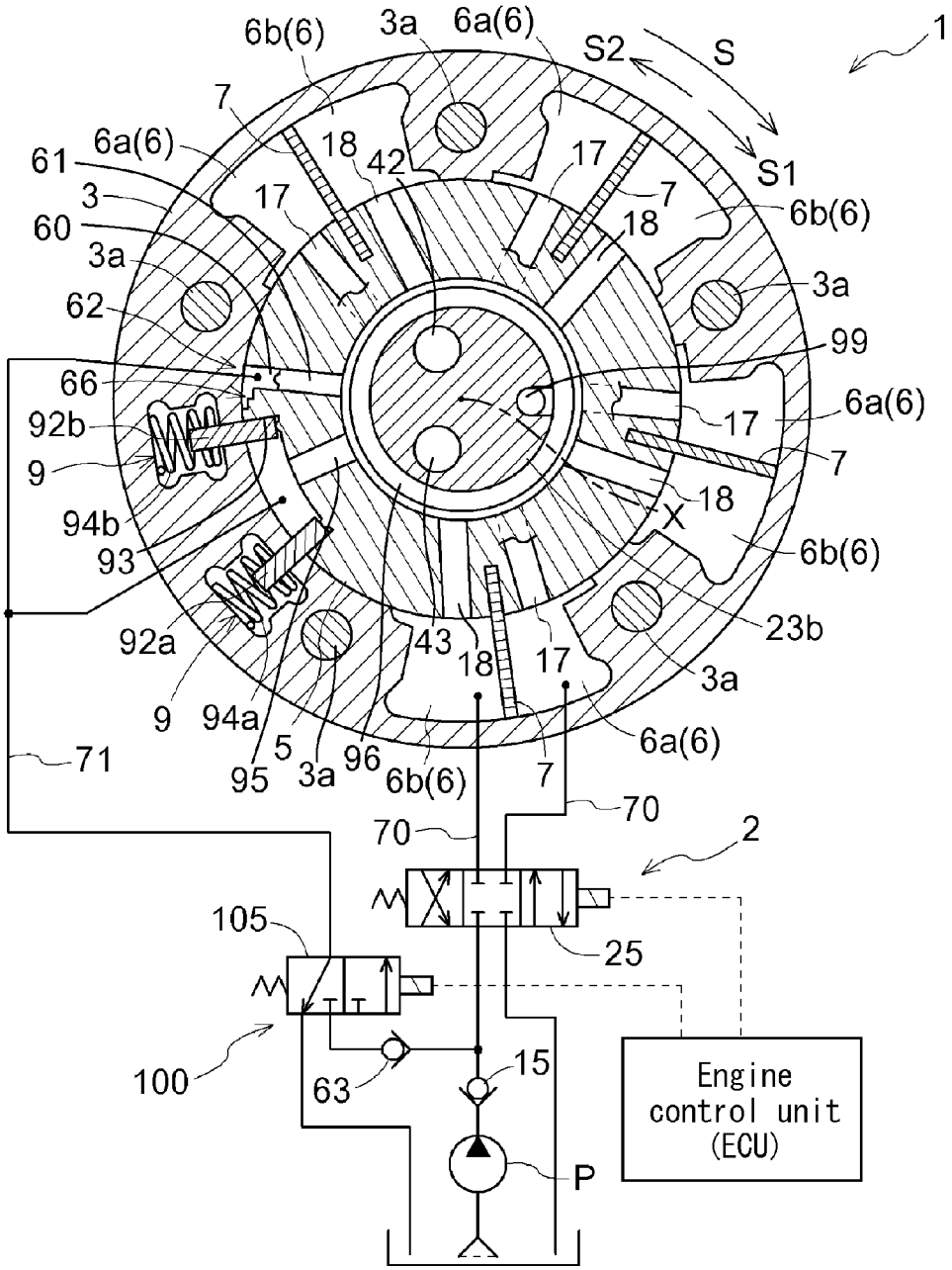
FIG. 3 is a cross-sectional view drawing taken along line III-III in FIG. 1 illustrating the first embodiment of the valve opening-closing timing control apparatus in an intermediate phase lock state.

Lock mechanisms of the valve opening-closing timing control apparatus 1 according to the first embodiment will be described next. As FIGS. 3 to 6 illustrate, between the outer rotor 3 and the inner rotor 5, an intermediate lock mechanism 9 and a most retarded angle lock mechanism 62 are provided. Note that, each of the intermediate lock mechanism 9 and the most retarded angle lock mechanism 62 serves as the lock mechanism. The intermediate lock mechanism 9 locks the rotational phase of the inner rotor 5 relative to the outer rotor 3 at an intermediate lock phase. The intermediate lock phase is a phase between the most retarded angle phase and the most advanced angle phase, which is illustrated in FIG. 3. The most retarded angle lock mechanism 62 locks the rotational phase of the inner rotor 5 relative to the outer rotor 3 at the most retarded angle phase, which is the phase illustrated in FIGS. 5 and 6.

The intermediate lock mechanism 9 and the most retarded angle lock mechanism 62 include a first lock member 92*b* and a second lock member 92*a*. The first lock member 92*b* and the second lock member 92*a* are attached to the outer rotor 3 such that the first lock member 92*b* and the second lock member 92*a* may protrude from and retract into the outer rotor 3. More specifically, an end portion of the first lock member 92*b* and an end portion of the second lock member 92*a*, each of which protrudes from the outer rotor 3, are configured to move in a direction that conforms to a direction perpendicular to the rotational axis X. The end portion of the first lock member 92*b* and the end portion of the second lock member 92*a* are configured to move in a direction to approach the inner rotor 5 or in a direction to be distanced from the inner rotor 5. The intermediate lock mechanism 9 and the most retarded angle lock mechanism 62 further include the first lock spring 94*b* and the second lock spring 94*a*. The first lock spring 94*b* serves as a biasing mechanism to bias the first lock member 92*b* in a direction to make the first lock member 92*b* protrude from the outer rotor 3. The second lock spring 94*a* serves as a biasing mechanism to bias the second lock member 92*a* in a direction to make the second lock member 92*a* protrude from the outer rotor 3.

The intermediate lock mechanism 9 includes the intermediate lock recess 93 formed on an outer peripheral portion of the inner rotor 5 formed in a groove form that extends in a circumferential direction of the inner rotor 5 in order to simultaneously receive the first lock member 92*b* and the second lock member 92*a* that are inserted into the intermediate lock recess 93 so that the first lock member 92*b* and the second lock member 92*a* are engaged with the intermediate lock recess 93. Note that, the each of the first lock member 92*b* and the second lock member 92*a* serves as the lock member and the intermediate lock recess 93 serves as the lock recess. Accordingly, the intermediate lock mechanism 9 is partially arranged on the outer rotor 3 and partially arranged on the inner rotor 5 so that the first lock member 92*b* and the second lock member 92*a* may be selectively engaged with the intermediate lock recess 93.

Figure 6:
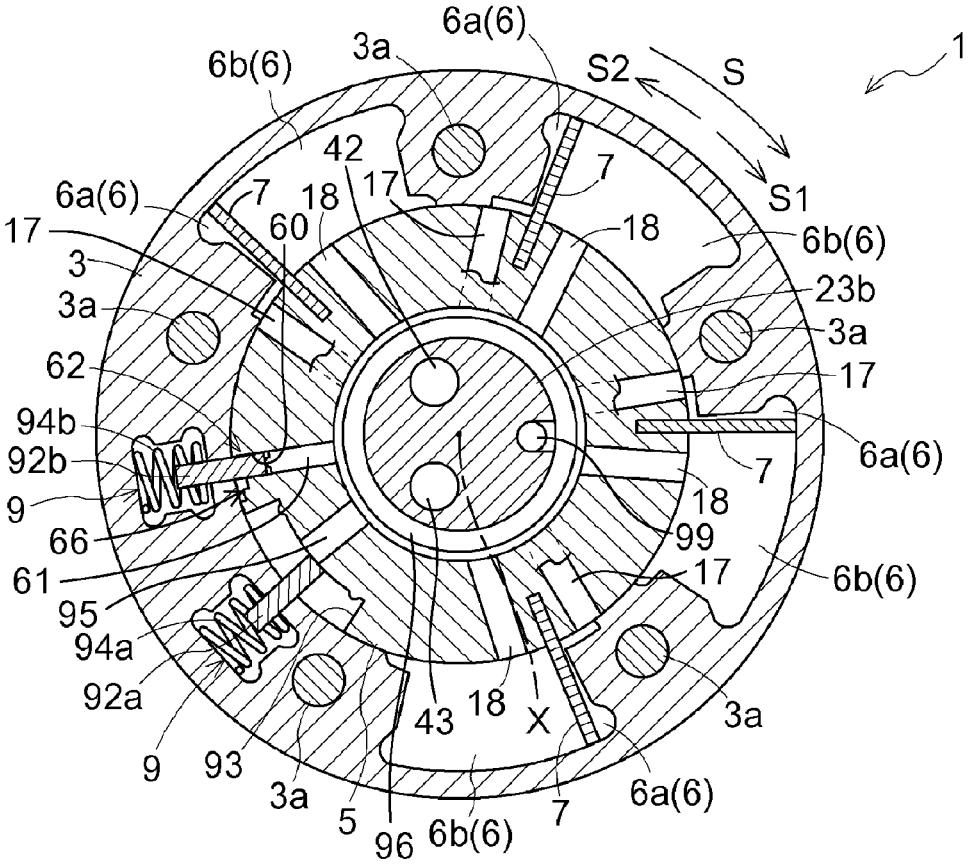
FIG. 6 is a cross-sectional view drawing taken along line VI-VI in FIG. 1 illustrating the first embodiment of the valve opening-closing timing control apparatus locked at the most retarded angle phase.

The most retarded angle lock mechanism 62 includes the most retarded angle lock recess 60 on the inner rotor 5. The first lock member 92*b* is inserted into the most retarded angle lock recess 60 so that the first lock member 92*b* is engaged with the most retarded angle lock recess 60. Note that, the most retarded angle lock recess 60 serves as the lock recess. As FIG. 6 illustrates, by inserting the first lock member 92*b* into the most retarded angle lock recess 60, the most retarded angle lock mechanism 62 shifts the rotational phase of the inner rotor 5 relative to the outer rotor 3 to the most retarded angle phase, which is a phase at which a compression ratio of an intake air is lowered to decrease load on the engine E, which is an internal combustion engine, at the time at which the engine E is started.

The most retarded angle lock recess 60 is provided with a ratchet mechanism 66, which is formed stepwise. The ratchet mechanism 66 is recessed stepwise in the advanced angle direction S1. The ratchet mechanism 66 allows the first lock member 92*b* to stepwisely engage with the most retarded angle lock recess 60 as the inner rotor 5 moves relative to the outer rotor 3 in the retarded angle direction S2.

Figure 4:
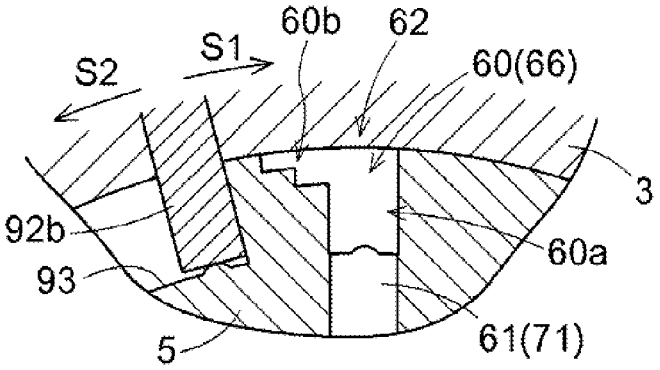
FIG. 4 is an enlarged cross-sectional view drawing of the first embodiment of the valve opening-closing timing control apparatus illustrating a most retarded angle lock recess.

More specifically, as FIG. 4 illustrates, the most retarded angle lock recess 60, which is formed at most retarded angle phase position, is formed stepwise and includes a most retarded angle lock recess portion 60*a* and a guide recess portion 60*b*. The most retarded angle lock recess portion 60*a* is a recess in which the first lock member 92*b* enters at a time at which the rotational phase reaches the most retarded angle phase. The guide recess portion 60*b* is recessed shallower than the most retarded angle lock recess portion 60*a*. The guide recess portion 60*b* is the recess in which the first lock member 92*b* may enter prior to the rotational phase reaching the most retarded angle phase.

As a result, in a state where the inner rotor 5 rotates in a direction opposite to the most retarded angle phase upon the inner rotor 5 reaches the most retarded angle phase position, a rotation range of the inner rotor 5 relative to the outer rotor 3 may be limited by the first lock member 92*b* positioned in the guide recess portion 60*b*. The most retarded angle lock recess portion 60*a* and the guide recess portion 60*b* are formed stepwise where the guide recess portion 60*b* is recessed shallower than the most retarded angle lock recess portion 60*a*. Accordingly, the first lock member 92*b* positioned in the guide recess portion 60*b* easily moves to the most retarded angle lock recess portion 60*a*. As a result, the rotational phase of the inner rotor 5 relative to the outer rotor 3 is swiftly locked at the most retarded angle phase.

Figure 2:
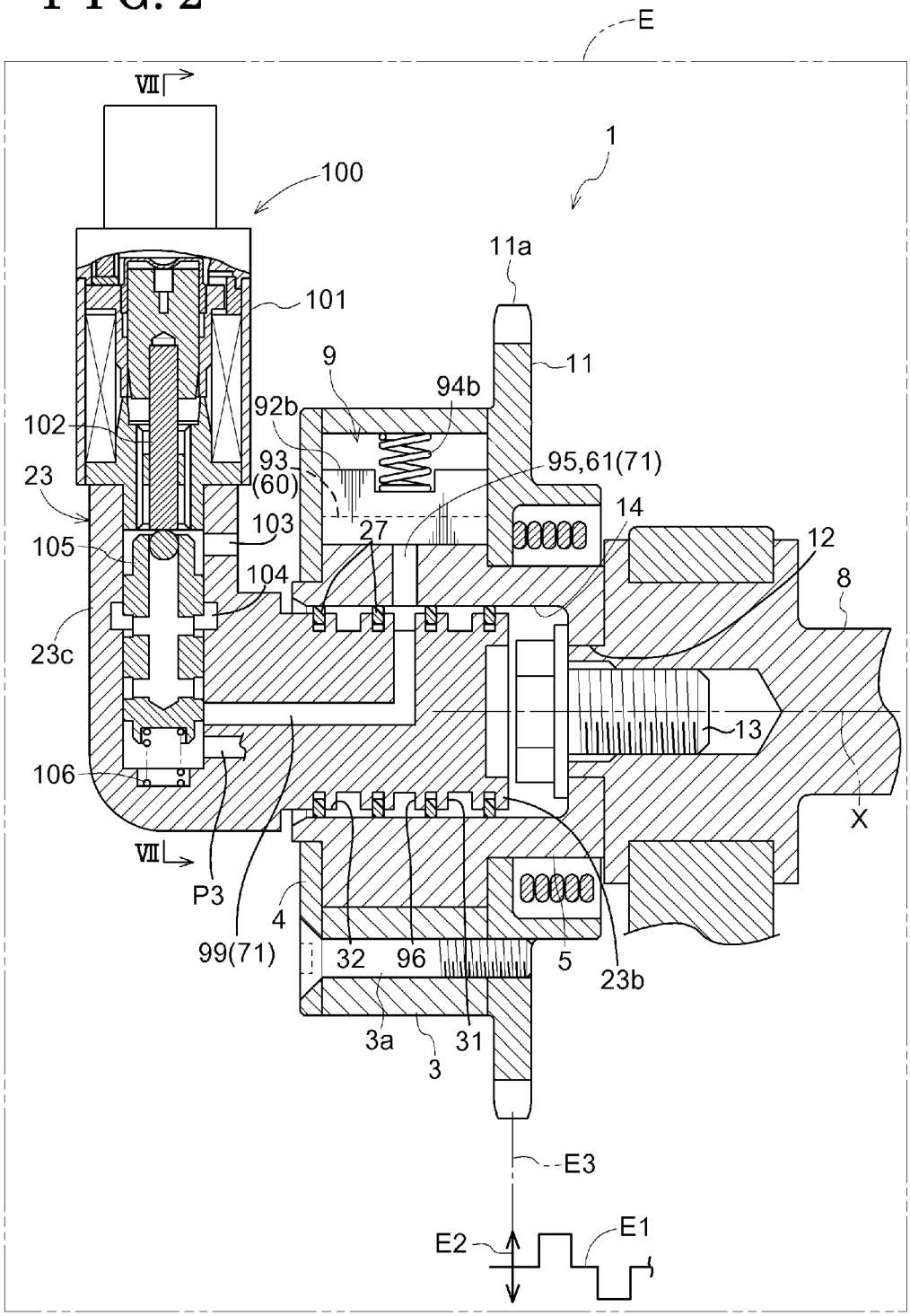
FIG. 2 is a cross-sectional view drawing conforming to the rotational axis of the first embodiment of the valve opening-closing timing control apparatus illustrating the first embodiment of the valve opening-closing timing control apparatus taken at a lock control valve portion.

A lock control portion of the valve opening-closing timing control apparatus 1 according to the first embodiment will be described next. The lock control portion is configured with a lock control valve portion 100. As FIGS. 2 and 7 illustrate, the lock control valve portion 100, which serves as the lock control portion, is arranged together with the fluid control valve portion 2 at a position next to the fluid control valve portion 2 in the housing 23 to control supply and discharge of the pressurized fluid to and from the intermediate lock passage 95 and the most retarded angle lock passage 61. The fluid control valve portion 2 and the lock control valve portion 100 are integrated into a module in a state where the fluid control valve portion 2 and the lock control valve portion 100 are arranged adjacent to each other.

The lock control valve portion 100 supplies and discharges the operation oil discharged from the oil pump P to and from the intermediate lock recess 93 and the most retarded angle lock recess 60 from the lock passage 99 via the intermediate lock passage 95 and the most retarded angle lock passage 61 in order to switch a state of the intermediate lock mechanism 9 and the most retarded angle lock mechanism 62 between a locked state and an unlocked state. A lock controlling supply passage 71, which supplies the operation oil to the intermediate lock recess 93 and the most retarded angle lock recess 60, is configured with the lock passage 99, the intermediate lock passage 95, and the most retarded angle lock passage 61.

The fluid control valve portion 2 controls supply of the operation oil to the phase controlling supply passage 70. The lock control valve portion 100, which is a portion different from the fluid control valve portion 2, controls supply of the operation oil to the lock controlling supply passage 71. Accordingly, each of the phase controlling supply passage 70 and the lock controlling supply passage 71 is configured to independently supply the operation oil. As a result, regardless of whether or not the operation oil is supplied to the advanced angle chamber 6*a* or to the retarded angle chamber 6*b*, the operation oil is supplied to the most retarded angle lock recess 60 so that the most retarded angle lock mechanism 62 may be swiftly operated.

The lock control valve portion 100 includes a solenoid 101, the housing 23, and a spool 105. The spool 105 is formed in a hollow cylinder form having a bottom. The housing 23 includes a second spool housing portion 23*c* housing the spool 105.

The second spool housing portion 23*c* is formed with a hollow portion 104 to contain the spool 105. The hollow portion 104 is formed in a hollow cylinder form. The hollow portion 104 contains the spool 105 in a state in which the spool 105 may linearly move in a direction perpendicular to the rotational axis X of the camshaft 8.

A spring 106 is arranged to span between the spool 105 and a bottom surface of the hollow portion 104. The spool 105 is biased in a direction toward the solenoid 101 of the hollow portion 104 by the spring 106.

The solenoid 101 is arranged at an open end portion of the second spool housing portion 23*c*. The solenoid 101 makes the spool 105 reciprocate in the direction perpendicular to the rotational axis X of the camshaft 8. A rod 102 at an end portion of the solenoid 101 is arranged such that the rod 102 makes contact with a bottom portion of the spool 105. In a state where the solenoid 101 is supplied with electricity, the rod 102 protrudes from the solenoid 101 and pushes the bottom portion of the spool 105 so that the spool 105 moves in a downward direction in FIG. 2.

In a state where supply of electricity to the solenoid 101 is cut off, the rod 102 retracts in a direction toward the solenoid 101. Accordingly, biased by a biasing force of the spring 106, the spool 105 moves in the direction toward the solenoid 101 along with movement of the rod 102. A configuration of the lock control valve portion 100 includes, for example, the solenoid 101, the rod 102, the spool 105, and the spring 106. Note that, the second spool housing portion 23*c* is formed with a through-hole 103 at a portion in a direction of the open end portion of the second spool housing portion 23*c*. The through-hole 103 is connected to outside and circulates air to make the spool 105 reciprocate in high speed. Furthermore, the through-hole 103 is configured to discharge leaked operation oil to the outside.

As FIGS. 1, 2, and 7 illustrate, the housing 23 includes the second spool housing portion 23*c* housing the spool 105 of the lock control valve portion 100 in addition to the first spool housing portion 23*a* housing the spool 25 and the protruding portion 23*b* inserted into the recess portion 14.

The second spool housing portion 23*c*, which is arranged next to the first spool housing portion 23*a*, is arranged to conform to a direction perpendicular to an extending direction of the protruding portion 23*b*, which is a direction perpendicular to an extending direction of the camshaft 8. As FIG. 7 illustrates, the first spool housing portion 23*a* and the second spool housing portion 23*c* are arranged on substantially same plane when the first spool housing portion 23*a* and the second spool housing portion 23*c* are viewed in the extending direction of the protruding portion 23*b*, which is the extending direction of the camshaft 8.

As FIG. 2 illustrates, one end of the lock passage 99 is open to the hollow portion 104 and the other end communicates with the outer circumferential groove 96 for lock operation at all time. Furthermore, as FIG. 7 illustrates, between the supply-side passage 47 and the hollow portion 104, a supply passage 48 where the operation oil discharged from the oil pump P flows into the lock control valve portion 100 is formed.

The supply passage 48 includes a second check valve 63, which serves as a one-way valve, in order to block an operation oil for lock release from flowing into the phase controlling supply passage 70. The second check valve 63 blocks the flow of the operation oil for lock release when a pressure of the operation oil discharged from the oil pump P becomes lower than a pressure of the operation oil for lock release supplied to the lock controlling supply passage 71 at a time at which the operation oil discharged from the oil pump P is supplied to the intermediate lock recess 93 and the most retarded angle lock recess 60 and retaining the intermediate lock mechanism 9 and the most retarded angle lock mechanism 62 in the unlocked state. Accordingly, regardless of whether or not the operation oil is supplied to the phase controlling supply passage 70, an hydraulic pressure of the operation oil supplied to the lock controlling supply passage 71 is retained so that the most retarded angle lock mechanism 62 is smoothly operated.

The supply passage 48 is formed to extend through a separation portion 64 formed between the fluid control valve portion 2 and the lock control valve portion 100 such that the operating oil discharged from the oil pump P reaches the lock control valve portion 100, which serves as the lock control portion, via the fluid control valve portion 2. The second check valve 63 includes a sleeve 48*a*, a spherical valve body 48*b*, and a spring 48*c*. The sleeve 48*a* internally fits to the supply passage 48, which is formed concentric to the supply-side passage 47. The spherical valve body 48*b* is attached to an internal space of the sleeve 48*a*. The spring 48*c* biases the spherical valve body 48*b* toward an upstream side of the supply passage 48. The second check valve 63 is attached to the supply passage 48 through the supply-side passage 47.

Figure 8:
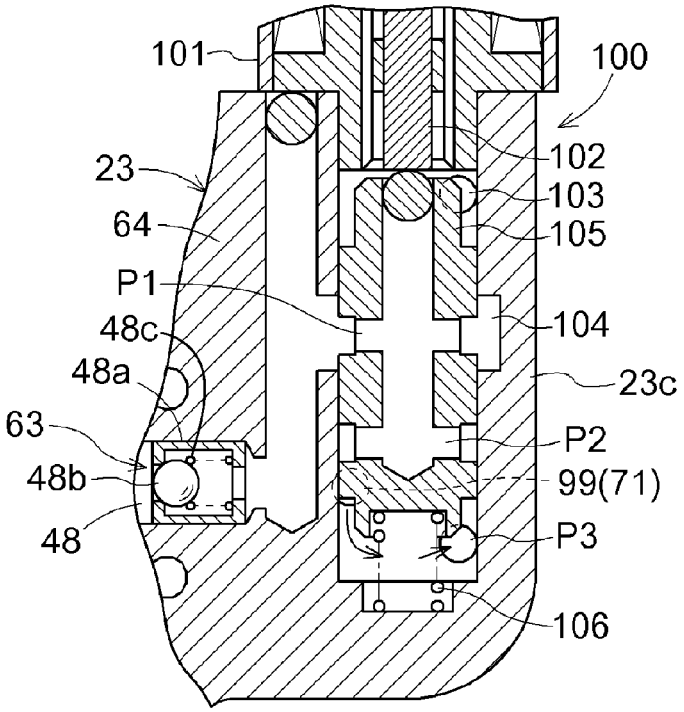
FIG. 8 is a cross-sectional view drawing illustrating the lock control valve portion of the first embodiment of the valve opening-closing timing control apparatus in a locked state, which is a state in which the lock control valve portion is at a lock position.
Figure 9:
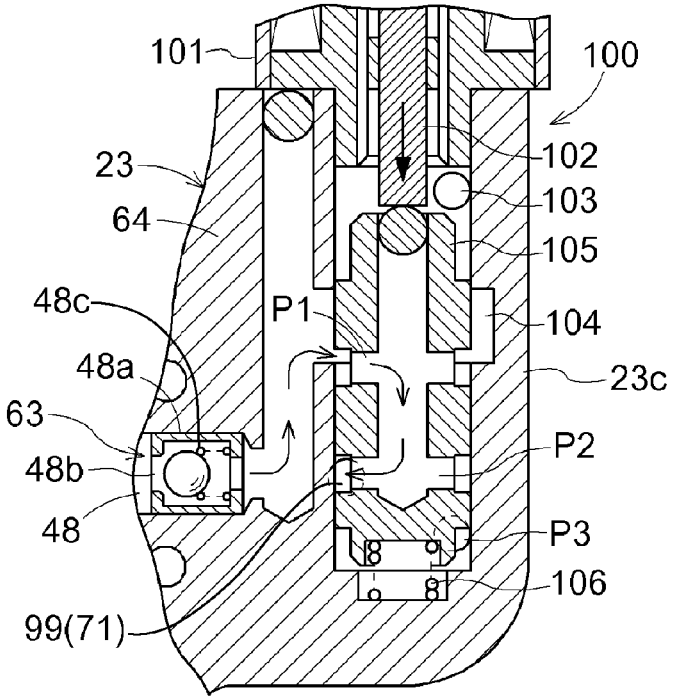
FIG. 9 is a cross-sectional view drawing illustrating the lock control valve portion of the first embodiment of the valve opening-closing timing control apparatus in an unlocked state, which is a state in which the lock control valve portion is at an unlock position.

An operation of the lock control portion of the valve opening-closing timing control apparatus according to the first embodiment will be described next. The operation of the lock control valve portion 100, which serves as the lock control portion, will be described referring to FIGS. 8 to 10. The lock control valve portion 100 is configured to switch a position of the spool 105 between a lock position, which is illustrated in FIG. 8, and an unlock position, which is illustrated in FIG. 9. The unlock position is alternatively referred to as a duty position. The lock position refers to a position that switches the state of the intermediate lock mechanism 9 and the most retarded angle lock mechanism 62 into the locked state. The unlock position refers to a position that switches the state of the intermediate lock mechanism 9 and the most retarded angle lock mechanism 62 to the unlocked state at the time at which the engine E is started and during a period during which the engine E is driven.

FIG. 8 illustrates a state in which the position of the spool 105 is switched to the lock position at a time at which the engine E is stopped. In this state, the solenoid 101 is not supplied with electricity and a position of the spool 105 is at a position closest to the solenoid 101.

At the lock position, the operation oil discharged from the oil pump P opens the second check valve 63 in a state where the hydraulic pressure is equal to or more than a predetermined hydraulic pressure so that the operation oil flows into the spool 105 through an inflow port P1 formed on the spool 105 from the supply-side passage 47 via the supply passage 48, however, communication between an outflow port P2, which is separately formed on the spool 105, and the lock passage 99 is cut off so that the operation oil does not flow into the lock passage 99. On the other hand, the lock passage 99 is communicated with a drain passage P3 so that the operation oil in the intermediate lock recess 93 and the most retarded angle lock recess 60 may be discharged through the drain passage P3 from the lock passage 99 via the intermediate lock passage 95 and the most retarded angle lock passage 61.

Accordingly, at the time at which the engine E is stopped, the first lock member 92*b* and the second lock member 92*a* are inserted into the intermediate lock recess 93 to switch the rotational phase of the inner rotor 5 relative to the outer rotor 3 to the locked state where the rotational phase is locked at the intermediate lock phase. A position of the spool 105 in this state is referred to as an intermediate lock position.

FIG. 9 illustrates a state in which the position of the spool 105 is switched to the unlock position at the time at which the engine E is started or during the period during which the engine E is driven. At the unlock position, the inflow port P1 communicates with the lock passage 99 via the outflow port P2. The operation oil discharged from the oil pump P opens the second check valve 63 in a state where the hydraulic pressure of the operation oil is equal to or more than the predetermined hydraulic pressure. Accordingly, the operation oil flows from the supply passage 48 into inside of the spool 105 through the inflow port P1 so that the operation oil is supplied to the intermediate lock recess 93 and the most retarded angle lock recess 60 through the lock passage 99 via the outflow port P2.

As a result, the intermediate lock mechanism 9 and the most retarded angle lock mechanism 62 are switched to the unlocked state so that the rotational phase of the inner rotor 5 relative to the outer rotor 3 may be shifted to a selected rotational phase.

The intermediate lock mechanism 9 and the most retarded angle lock mechanism 62 are retained in the unlocked state by supplying the operation oil for lock release to the intermediate lock recess 93 and the most retarded angle lock recess 60, which in turn makes the first lock member 92*b* and the second lock member 92*a* retract from the intermediate lock recess 93 and the most retarded angle lock recess 60 by the hydraulic pressure of the operation oil for lock release.

Figure 10:
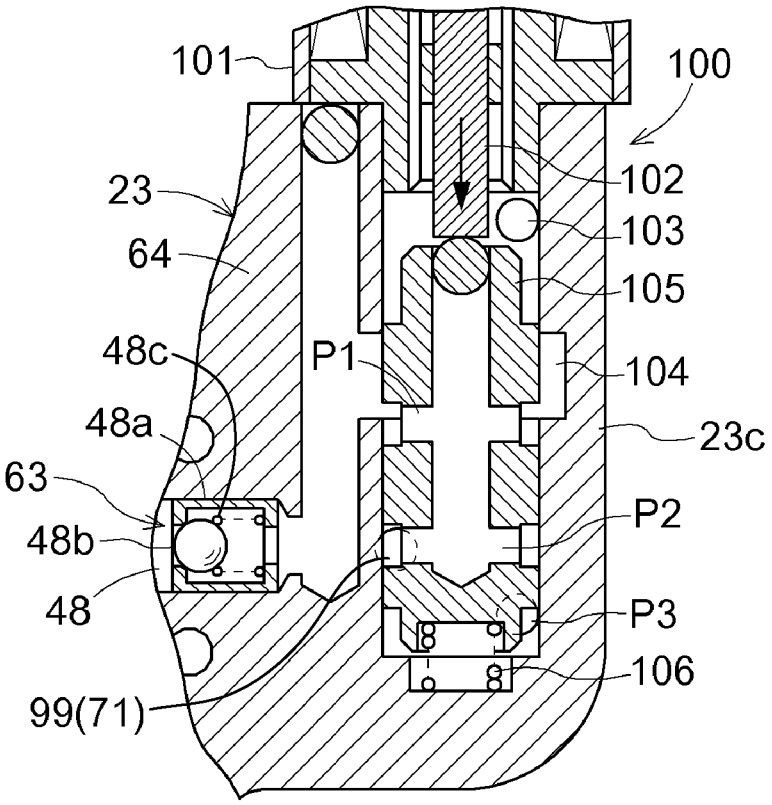
FIG. 10 is a cross-sectional view drawing illustrating the lock control valve portion of the first embodiment of the valve opening-closing timing control apparatus at a time at which a fluid pressure of a pressurized fluid for phase change has fallen in a state in which the lock control valve portion is in the unlocked state.

FIG. 10 illustrates a state in which the hydraulic pressure of the operation oil discharged from the oil pump P has fallen as a result of supplying the operation oil for phase change to the advanced angle chamber 6*a* or to the retarded angle chamber 6*b* in order to shift the rotational phase of the inner rotor 5 relative to the outer rotor 3 while retaining the intermediate lock mechanism 9 and the most retarded angle lock mechanism 62 in the unlocked state. In this state, the second check valve 63 is closed by the hydraulic pressure of the operation oil for lock release until the hydraulic pressure of the operation oil for phase change rises to the predetermined hydraulic pressure. Accordingly, falling of the hydraulic pressure of the operation oil for lock release is prevented so that the intermediate lock mechanism 9 and the most retarded angle lock mechanism 62 are retained in the unlocked state.

Figure 5:
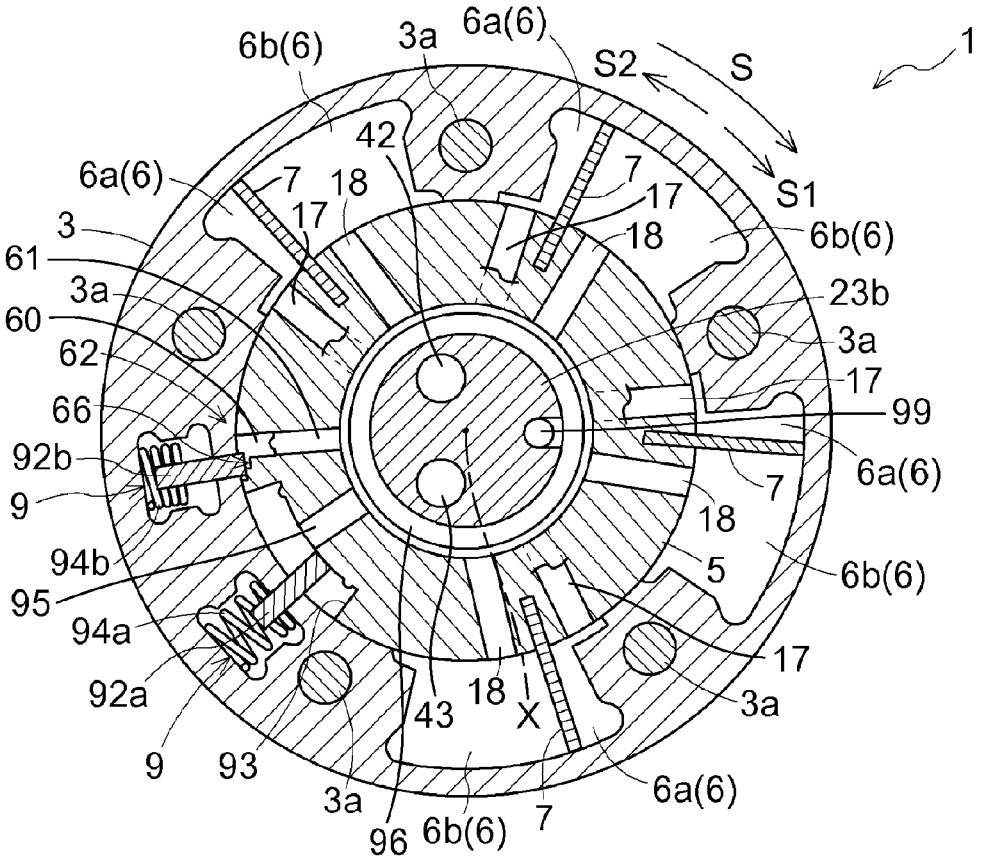
FIG. 5 is a cross-sectional view drawing taken along line V-V in FIG. 1 illustrating the first embodiment of the valve opening-closing timing control apparatus in a state prior to a state in which the first embodiment of the valve opening-closing timing control apparatus is locked at most retarded angle phase.

And then, in a state where the spool 105 is switched to the lock position, which is illustrated in FIG. 8, to stop supply of the operation oil for lock release to the intermediate lock recess 93 and to communicate the intermediate lock recess 93 with the drain passage P3 via the lock passage 99, a lock operation by the most retarded angle lock mechanism 62 is allowed. Accordingly, the first lock member 92*b* is stepwisely positioned to the most retarded angle lock recess 60 by using a ratchet form of the ratchet mechanism 66, as FIGS. 5 and 6 illustrate, so that the rotational phase of the inner rotor 5 relative to the outer rotor 3 may be shifted to the most retarded angle phase, which is a phase that reduces the load on the engine E, which is an internal combustion engine, at the time at which the engine E is started by lowering the compression ratio of the intake air.

Figure 11:
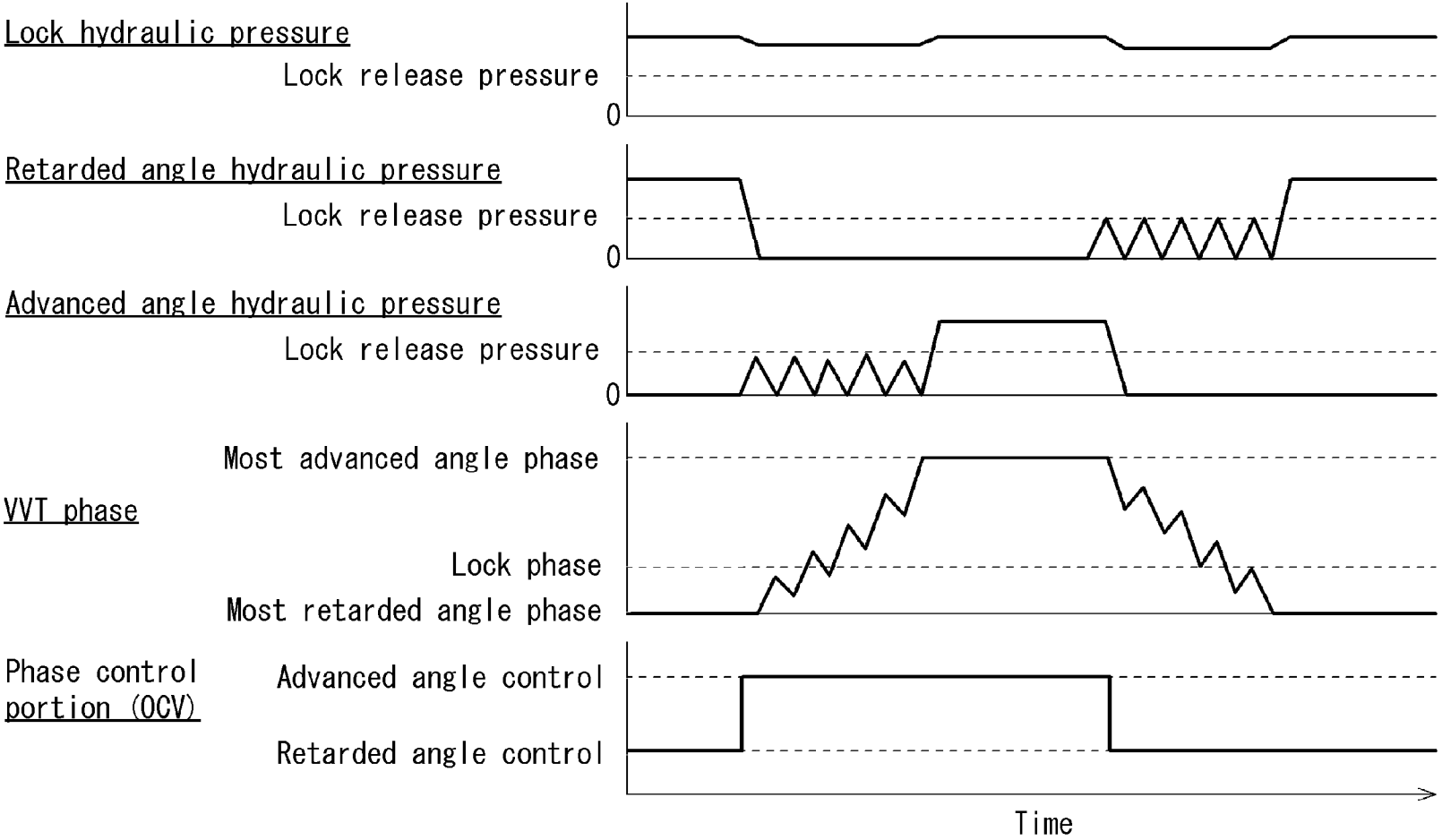
FIG. 11 is a time chart illustrating changes of fluid pressure in the first embodiment of the valve opening-closing timing control apparatus.
Figure 12:
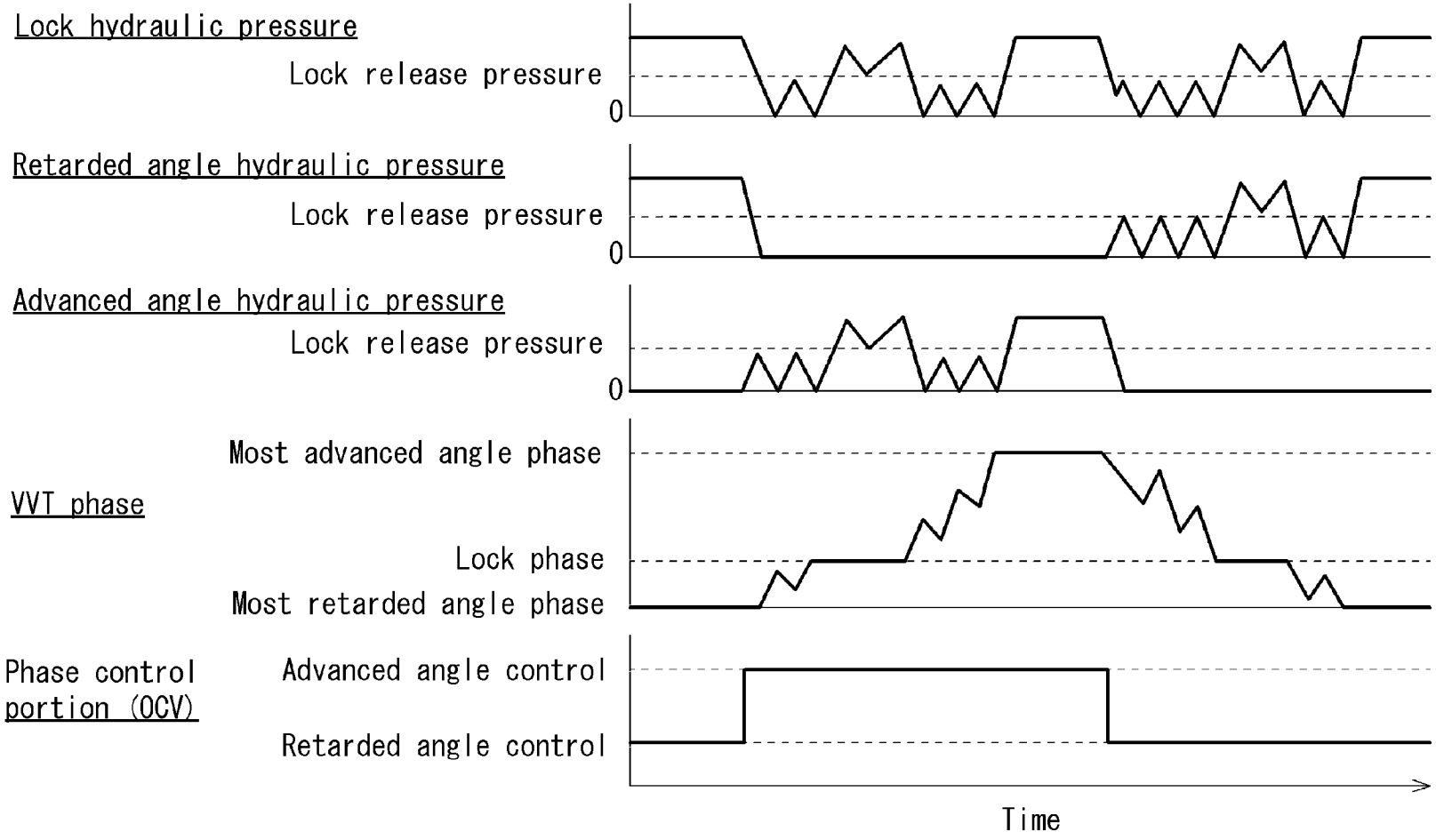
FIG. 12 is a time chart illustrating changes of fluid pressure in a valve opening-closing timing control apparatus provided as a comparison.
Figure 13:
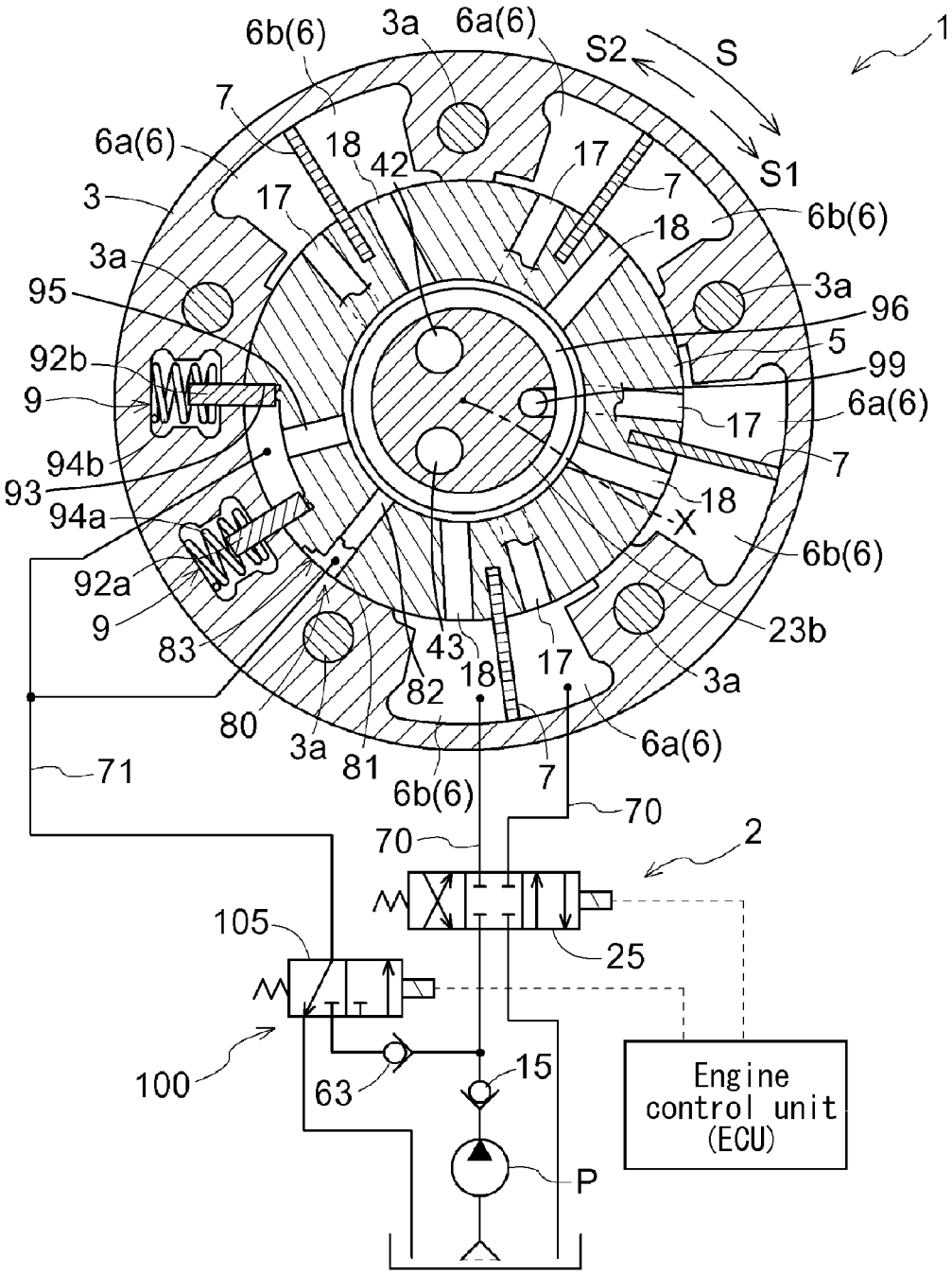
FIG. 13 is a cross-sectional view drawing taken along a direction perpendicular to a rotational axis illustrating a second embodiment of the valve opening-closing timing control apparatus in an intermediate phase lock state.

FIGS. 11 and 12 are time charts illustrating changes in hydraulic pressure, or fluid pressure, in the operation oil for lock release and the operation oil for phase change during a period during which the rotational phase of the inner rotor 5 relative to the outer rotor 3 is shifted from the most retarded angle phase to the most advanced angle phase and then shifted back to the most retarded angle phase while the operation oil for lock release is supplied from the lock passage 99 to the most retarded angle lock recess 60 and to the intermediate lock recess 93, each of which serves as the lock recess, to retain the intermediate lock mechanism 9 and the most retarded angle lock mechanism 62 in the unlocked state. Note that, the hydraulic pressure in the operation oil for lock release is alternatively referred to as a lock hydraulic pressure and the hydraulic pressure in the operation oil for phase change is referred to as a retarded angle hydraulic pressure and as an advanced angle hydraulic pressure.

FIG. 11 illustrates the time chart of the valve opening-closing timing control apparatus according to the first embodiment, which is provided with the second check valve 63, and FIG. 12 illustrates the time chart of a valve opening-closing timing control apparatus provided without the second check valve 63 for comparison. As FIG. 12 illustrates, in the valve opening-closing timing control apparatus provided without the second check valve 63, each of the lock hydraulic pressure and the advanced angle hydraulic pressure greatly pulsates, or rises and falls, and includes moments at which hydraulic pressure drops to a pressure that is equal to or less than a hydraulic pressure for lock release, which is the hydraulic pressure that may retain lock mechanisms in the unlocked state, during a period during which the rotational phase shifts to the most advanced angle phase by operating an advanced angle control. Accordingly, the rotational phase may not be smoothly shifted to the most advanced angle phase. Likewise, each of the lock hydraulic pressure and the retarded angle hydraulic pressure greatly pulsates and includes moments at which hydraulic pressure drops to a pressure that is equal to or less than the hydraulic pressure for lock release during a period during which the rotational phase shifts to the most retarded angle phase by operating a retarded angle control. Accordingly, the rotational phase may not be smoothly shifted to the most retarded angle phase.

As FIG. 11 illustrates, in the valve opening-closing timing control apparatus 1 according to the first embodiment, which is provided with the second check valve 63, a falling amount of each of the lock hydraulic pressure and the advanced angle hydraulic pressure is small and a range in which each of the lock hydraulic pressure and the advanced angle hydraulic pressure pulsates is small during a period during which the rotational phase shifts to the most advanced angle phase by operating the advanced angle control. Accordingly, the lock hydraulic pressure may be stably retained at a pressure that is equal to or more than the hydraulic pressure for lock release. Likewise, a falling amount of each of the lock hydraulic pressure and the retarded angle hydraulic pressure is small and a range in which each of the lock hydraulic pressure and the retarded angle hydraulic pressure pulsates is small during a period during which the rotational phase shifts to the most retarded angle phase by operating the retarded angle control. Accordingly, the lock hydraulic pressure may be stably retained at a pressure that is equal to or more than the hydraulic pressure for lock release.

Accordingly, in the valve opening-closing timing control apparatus 1 according to the first embodiment, which is provided with the second check valve 63, the first lock member 92*b* and the second lock member 92*a*, each of which serves as the lock member, is less likely to engage again with the most retarded angle lock recess 60 and with the intermediate lock recess 93, each of which serves as the lock recess, at a time at which the advanced angle control or the retarded angle control is initiated while switching the state of the lock mechanism, which includes the intermediate lock mechanism 9 and the most retarded angle lock mechanism 62, from the locked state to the unlocked state. As a result, the rotational phase may be smoothly shifted.

Figure 15:
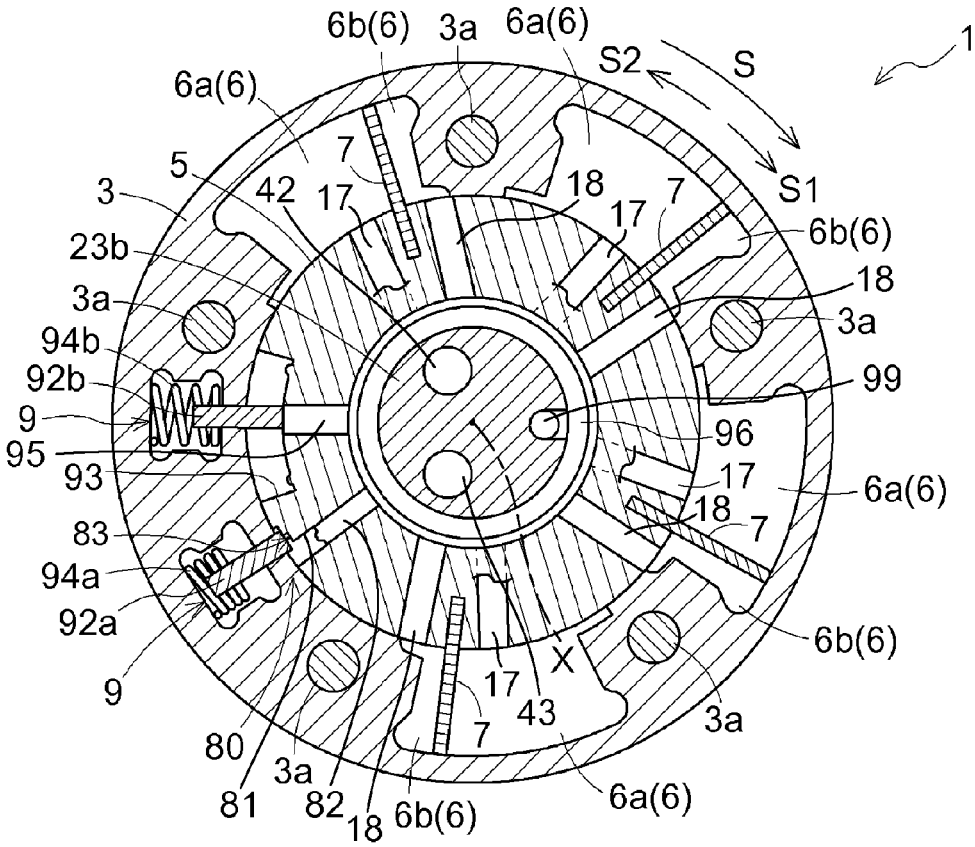
FIG. 15 is a cross-sectional view drawing taken along the direction perpendicular to the rotational axis illustrating the second embodiment of the valve opening-closing timing control apparatus in a state prior to a state in which the second embodiment of the valve opening-closing timing control apparatus is locked at most advanced angle phase.
Figure 16:
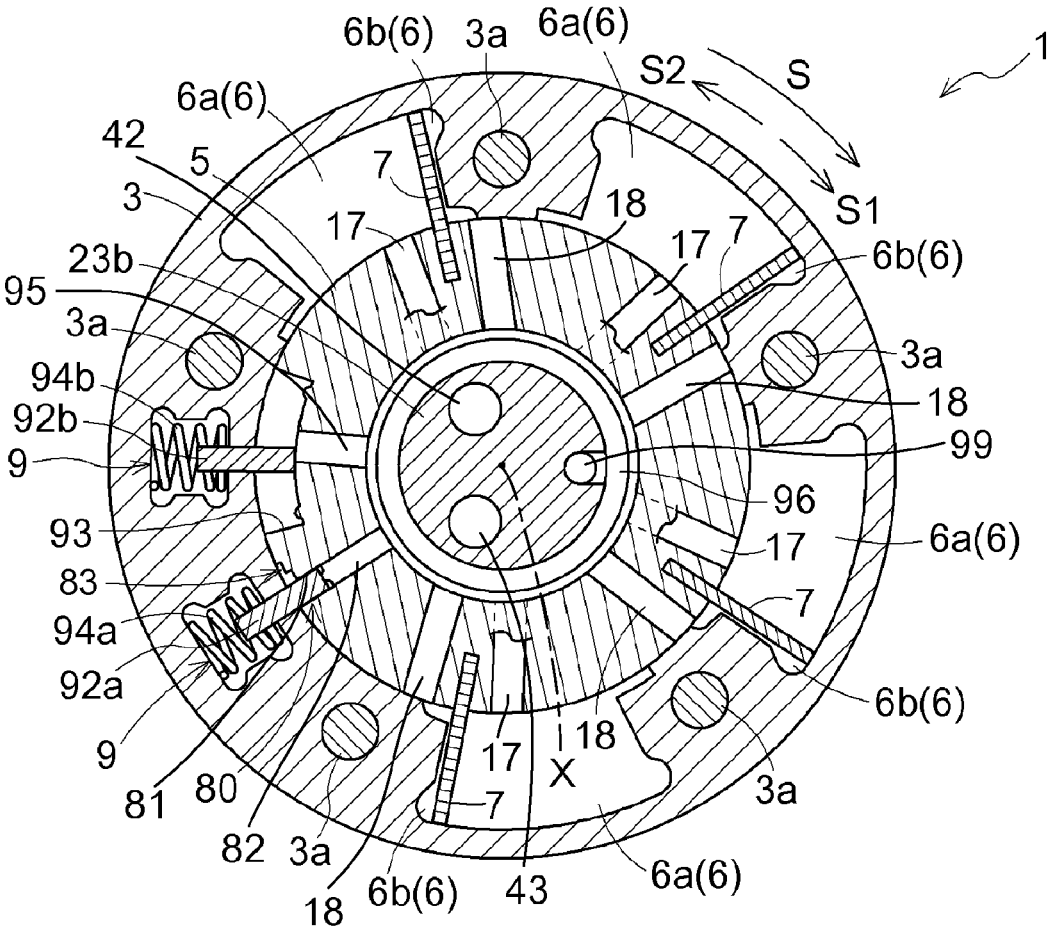
FIG. 16 is a cross-sectional view drawing taken along the direction perpendicular to the rotational axis illustrating the second embodiment of the valve opening-closing timing control apparatus locked at the most advanced angle phase.

The valve opening-closing timing control apparatus 1 according to a second embodiment will be described next. FIGS. 13 to 16 illustrate the valve opening-closing timing control apparatus 1 according to the second embodiment. The valve opening-closing timing control apparatus 1 according to the second embodiment controls opening-closing timing of exhaust valves. Instead of the most retarded angle lock mechanism 62 provided in the valve opening-closing timing control apparatus 1 according to the first embodiment, the valve opening-closing timing control apparatus 1 according to the second embodiment is provided with a most advanced angle lock mechanism 80, which serves as the lock mechanism. The most advanced angle lock mechanism 80 locks the rotational phase of the inner rotor 5 relative to the outer rotor 3 at the most advanced angle phase, which is illustrated in FIGS. 15 and 16.

The most advanced angle lock mechanism 80 includes a most advanced angle lock recess 81, which serves as the lock recess, on the inner rotor 5. The most advanced angle lock recess 81 is where the second lock member 92*a* makes entry and engages with the most advanced angle lock recess 81. The most advanced angle lock recess 81 communicates with a most advanced angle lock passage 82. As FIGS. 15 and 16 illustrate, the most advanced angle lock mechanism 80 locks the rotational phase of the inner rotor 5 relative to the outer rotor 3 at the most advanced angle phase by stepwisely positioning, or inserting, the second lock member 92*a* into the most advanced angle lock recess 81. The most advanced angle phase is the phase at which a compression ratio of the intake air is lowered so that, for example, load on the engine E, which is an internal combustion engine, is reduced at a time at which the engine E is restarted after idling stop.

The most advanced angle lock recess 81 is provided with a ratchet mechanism 83, which is formed stepwise. The ratchet mechanism 83 is recessed stepwise in the retarded angle direction S2. The ratchet mechanism 83 allows the second lock member 92*a* to stepwisely engage with the most advanced angle lock recess 81 as the inner rotor 5 moves relative to the outer rotor 3 in the advanced angle direction S1.

Figure 14:
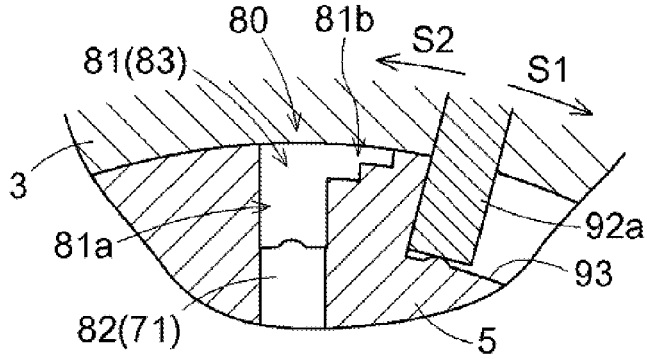
FIG. 14 is an enlarged cross-sectional view drawing of the second embodiment of the valve opening-closing timing control apparatus illustrating a most advanced angle lock recess.

More specifically, as FIG. 14 illustrates, the most advanced angle lock recess 81, which is formed at the most advanced angle phase position, is formed stepwise and includes a most advanced angle lock recess portion 81*a* and a guide recess portion 81*b*. The most advanced angle lock recess portion 81*a* is a recess in which the second lock member 92*a* enters at a time at which the rotational phase reaches the most advanced angle phase. The guide recess portion 81*b* is recessed shallower than the most advanced angle lock recess portion 81*a*. The guide recess portion 81*b* is the recess in which the second lock member 92*a* may enter prior to the rotational phase reaching the most advanced angle phase.

As a result, in a state where the inner rotor 5 rotates in a direction opposite to the most advanced angle phase upon the inner rotor 5 reaches the most advanced angle phase position, a rotation range of the inner rotor 5 relative to the outer rotor 3 may be limited by the second lock member 92*a* positioned in the guide recess portion 81*b*. The most advanced angle lock recess portion 81*a* and the guide recess portion 81*b* are formed stepwise where the guide recess portion 81*b* is recessed shallower than the most advanced angle lock recess portion 81*a*. Accordingly, the second lock member 92*a* positioned in the guide recess portion 81*b* easily moves to the most advanced angle lock recess portion 81*a*. As a result, the rotational phase of the inner rotor 5 relative to the outer rotor 3 is swiftly locked at the most advanced angle phase.

The lock controlling supply passage 71, which supplies the operation oil to the intermediate lock recess 93 and the most advanced angle lock recess 81, is configured with the lock passage 99, the intermediate lock passage 95, and the most advanced angle lock passage 82. In the valve opening-closing timing control apparatus 1 according to the second embodiment, similarly to the valve opening-closing timing control apparatus 1 according to the first embodiment, the fluid control valve portion 2 controls supply of the operation oil to the phase controlling supply passage 70. The lock control valve portion 100, which is a portion different from the fluid control valve portion 2, controls supply of the operation oil to the lock controlling supply passage 71. Accordingly, each of the phase controlling supply passage 70 and the lock controlling supply passage 71 is configured to independently supply the operation oil. As a result, regardless of whether or not the operation oil is supplied to the advanced angle chamber 6*a* or to the retarded angle chamber 6*b*, the operation oil is supplied to the most advanced angle lock recess 81 so that the most advanced angle lock mechanism 80 may be swiftly operated.

Furthermore, similarly to the valve opening-closing timing control apparatus 1 according to the first embodiment, the valve opening-closing timing control apparatus 1 according to the second embodiment is provided with a second check valve 63, which serves as the one-way valve. Accordingly, regardless of whether or not the operation oil is supplied to the phase controlling supply passage 70, the hydraulic pressure of the operation oil supplied to the lock controlling supply passage 71 is retained. As a result, the most advanced angle lock mechanism 80 is smoothly operated.

Other configurations of the most advanced angle lock mechanism 80 and the lock control valve portion 100 of the valve opening-closing timing control apparatus 1 according to the second embodiment may be understood by replacing a term "most retarded angle" of the description for the valve opening-closing timing control apparatus 1 according to the first embodiment with a term "most advanced angle." Accordingly, the descriptions in detail will be omitted. Note that, other configurations of the valve opening-closing timing control apparatus 1 according to the second embodiment is similar to the configurations of the valve opening-closing timing control apparatus 1 according to the first embodiment.

The valve opening-closing timing control apparatus 1 according to a third embodiment will be described next. FIGS. 17 to 22 illustrate the valve opening-closing timing control apparatus 1 according to the third embodiment. The lock control valve portion 100 of the valve opening-closing timing control apparatus 1 according to the third embodiment includes an accumulator 110 in addition to the solenoid 101, the housing 23, and the spool 105, which are provided in the lock control valve portion 100 of the valve opening-closing timing control apparatus 1 according to the first embodiment. Other configurations are similar between the valve opening-closing timing control apparatus 1 according to the first embodiment and the third embodiment.

Figure 17:
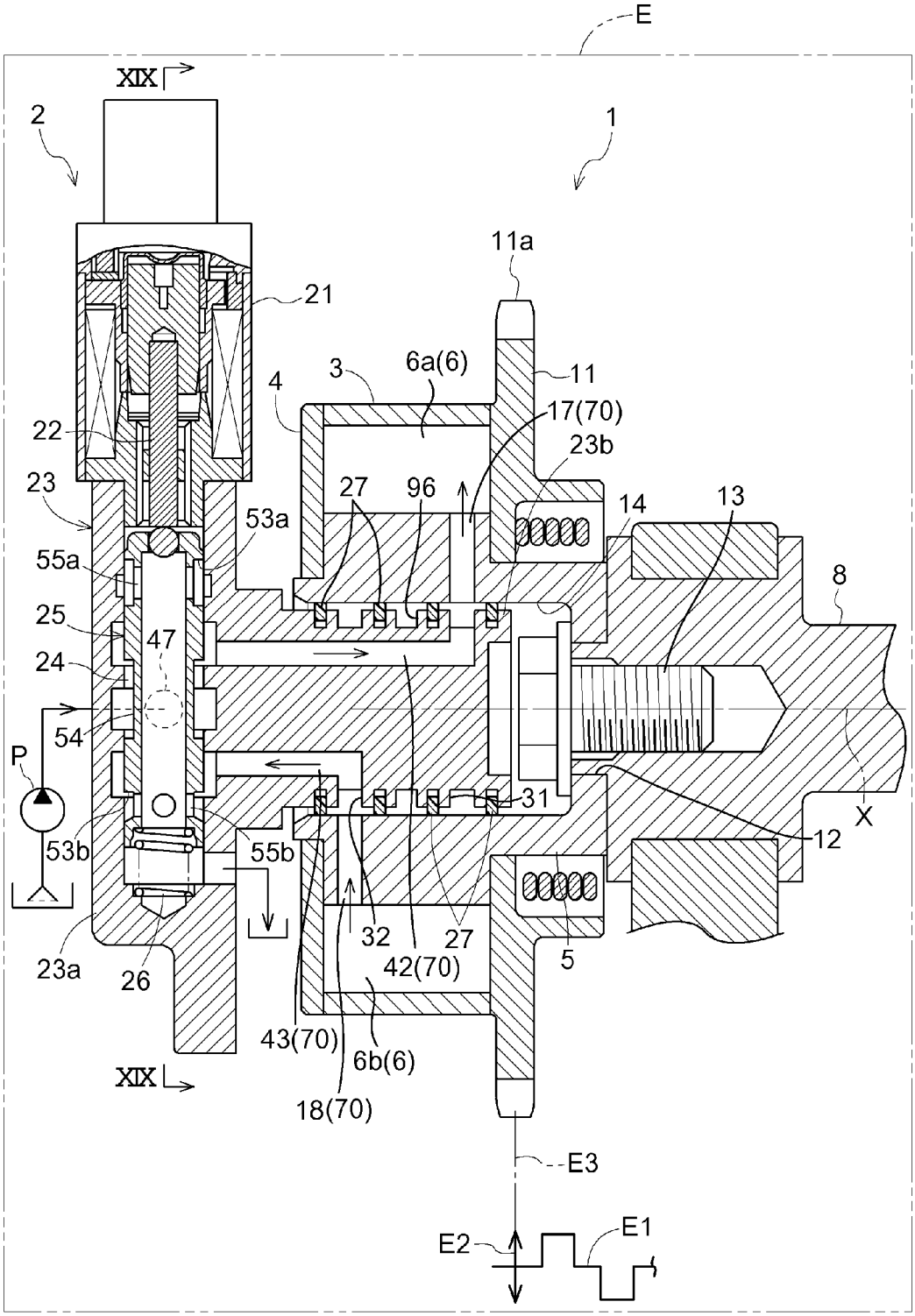
FIG. 17 is a cross-sectional view drawing conforming to a rotational axis of a third embodiment of the valve opening-closing timing control apparatus illustrating the third embodiment of the valve opening-closing timing control apparatus taken at a fluid control valve portion.
Figure 18:
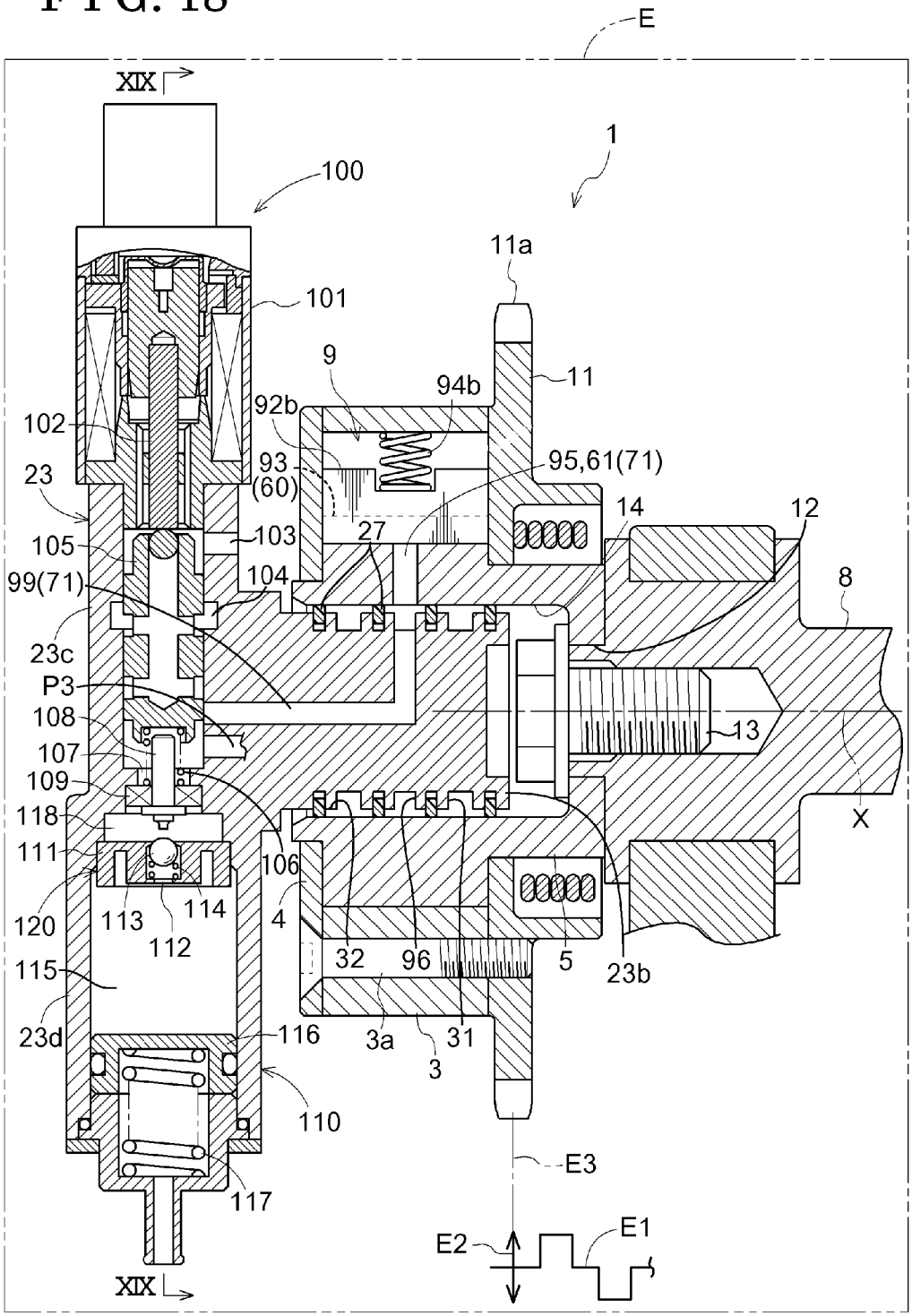
FIG. 18 is a cross-sectional view drawing conforming to the rotational axis of the third embodiment of the valve opening-closing timing control apparatus illustrating the third embodiment of the valve opening-closing timing control apparatus taken at a lock control valve portion.
Figure 19:
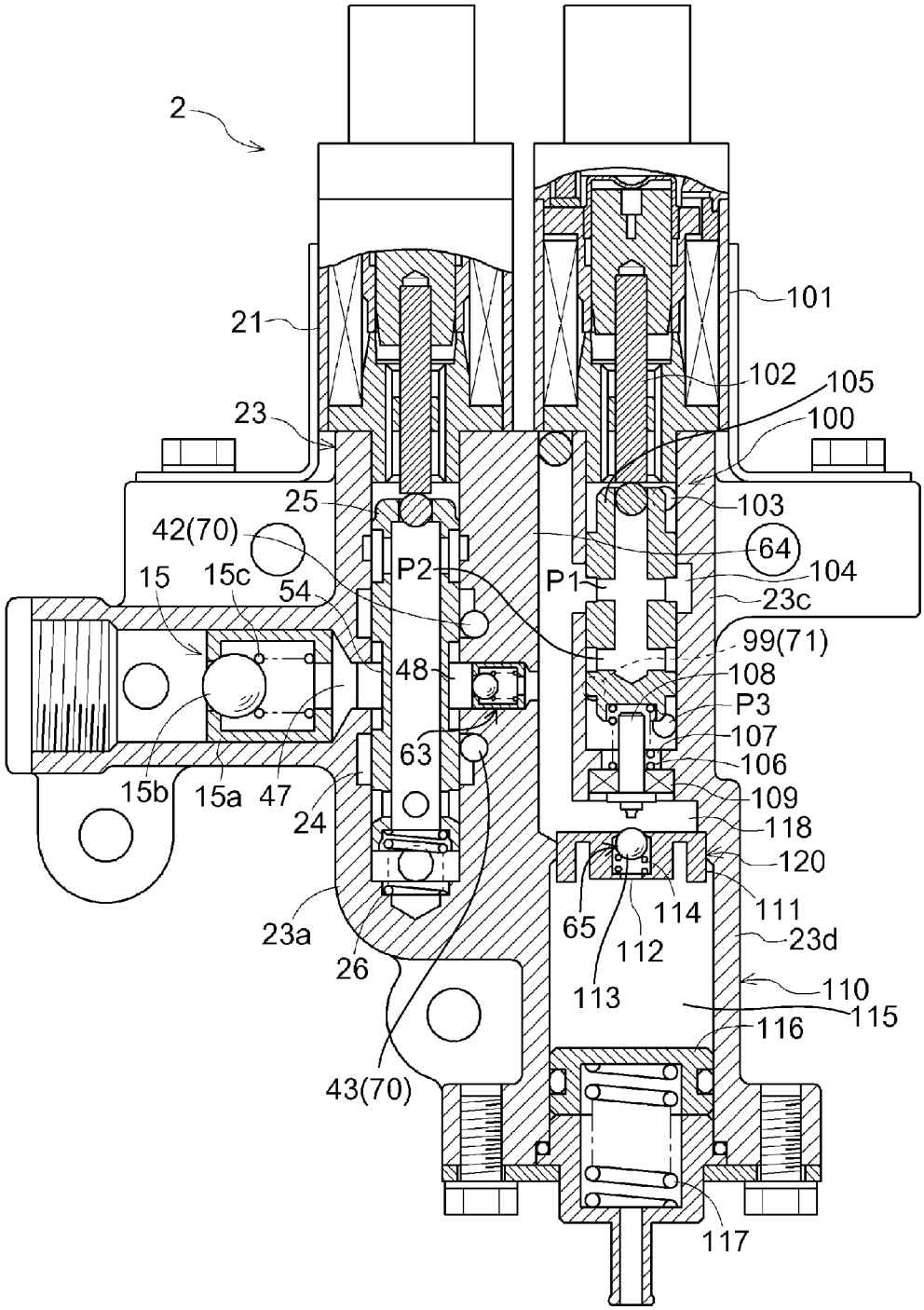
FIG. 19 is a cross-sectional view drawing of the third embodiment of the valve opening-closing timing control apparatus taken along line XIX-XIX in FIGS. 17 and 18.

As FIGS. 17 to 19 illustrate, the housing 23 includes an accumulator housing portion 23*d* housing the accumulator 110 in addition to the first spool housing portion 23*a*, the protruding portion 23*b* inserted into the recess portion 14, and the second spool housing portion 23*c*. The accumulator 110 stores the operation oil discharged from the oil pump P and supplies the operation oil for lock release to the lock control valve portion 100 at the time at which the engine E is started.

Near a bottom portion of the hollow portion 104 for containing the spool 105, a communication portion 107 that communicates with the accumulator 110 is formed. A push member 108 is arranged in the communication portion 107 to operate the accumulator 110 to open. A bearing member 109 is arranged at an outer periphery of the push member 108. The spring 106 is arranged to span between the spool 105 and the bearing member 109. In the hollow portion 104, the spool 105 is biased by the spring 106 toward the solenoid 101. The push member 108 is retained by the spring 106. In a state where the solenoid 101 is not supplied with electricity, the push member 108 is retained at a position spaced apart from an end portion of the spool 105.

The supply passage 48 includes the second check valve 63, which serves as the one-way valve, that blocks the operation oil for lock release that is discharged from the accumulator 110 from flowing into the phase controlling supply passage 70 when the pressure of the operation oil discharged from the oil pump P is lower than a pressure of the operation oil for lock release discharged from the accumulator 110 at a time at which the operation oil for lock release is supplied by the accumulator 110.

The accumulator 110 of the valve opening-closing timing control apparatus 1 according to the third embodiment will be described next. As FIGS. 18 and 19 illustrate, the accumulator 110 is arranged at a position at an extension of a reciprocating direction of the spool 105 of the lock control valve portion 100. The accumulator 110 is arranged via an accumulator control valve portion 120, which is an accumulator control portion. The accumulator 110 is a container for storing the operation oil that is supplied to the lock control valve portion 100 at the time at which the engine E is started in a pressurized state. The solenoid 101, which is a portion of the lock control valve portion 100, controls an operation of the accumulator control valve portion 120. In other words, the lock control valve portion 100 and the accumulator control valve portion 120 share the solenoid 101 in the valve opening-closing timing control apparatus 1 according to the third embodiment.

More specifically, the accumulator control valve portion 120 is configured with a partition wall portion 111 of the accumulator 110 in the hollow portion 104. Furthermore, a through-hole 112 of the partition wall portion 111 is arranged with a check valve 65 including a spherical valve body 113 and a spring 114. The spherical valve body 113 is arranged at a position at an extension of the reciprocating direction of the spool 105. The spring 114 biases the spherical valve body 113 in a direction to close the spherical valve body 113 to block the operating oil in the accumulator 110 from flowing back into the accumulator 110.

The accumulator 110 includes a movable wall portion 116 arranged at a position in an opposite direction relative to where the accumulator control valve portion 120 is arranged. The movable wall portion 116 is arranged at a position at an extension of the reciprocating direction of the spool 105 and moves in a direction conforming to the reciprocating direction of the spool 105 to change volume within a fluid storing portion 115. The movable wall portion 116 is provided with a spring 117 biasing the movable wall portion 116 to apply pressure on the operating oil within the fluid storing portion 115.

Figure 20:
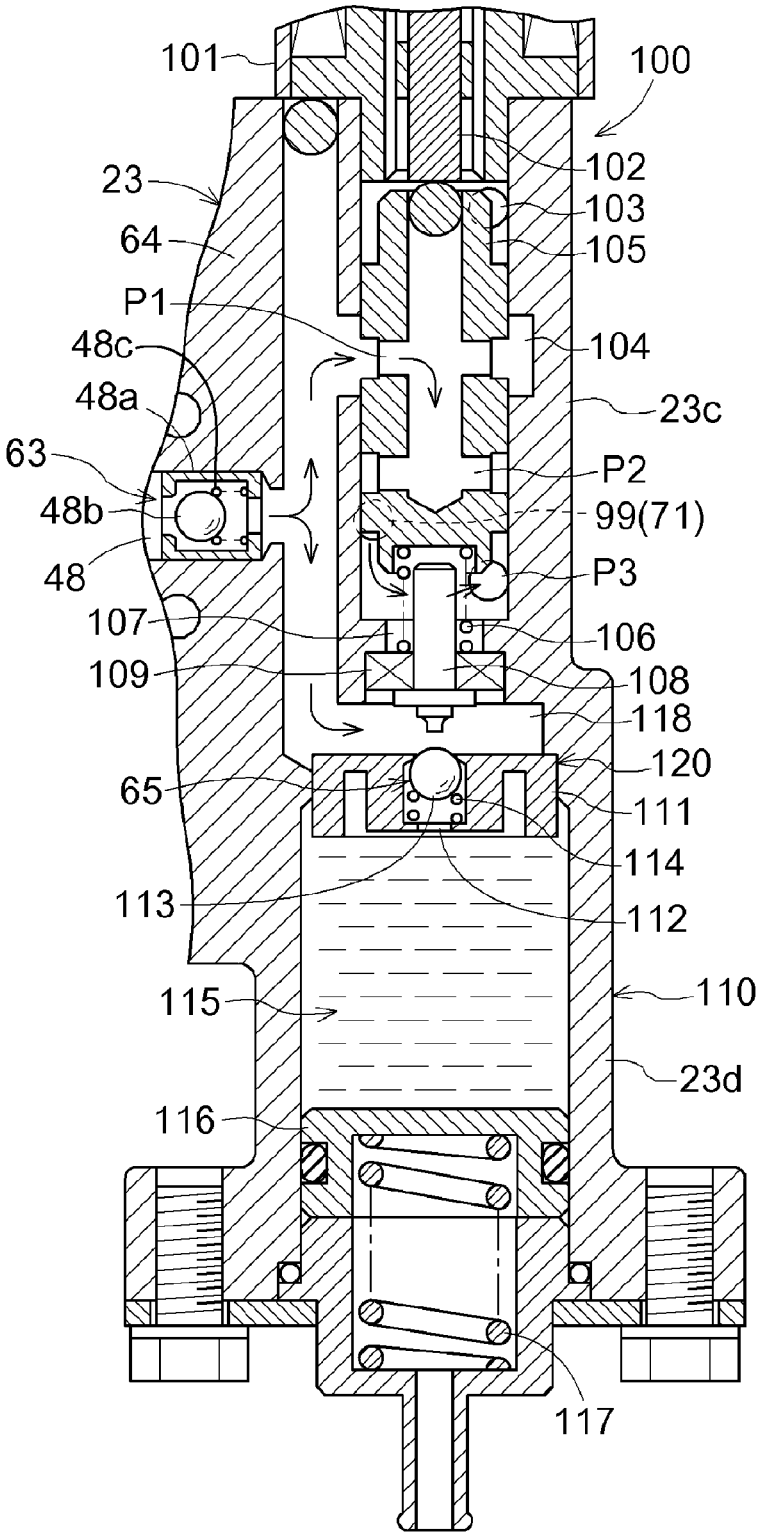
FIG. 20 is a cross-sectional view drawing of the lock control valve portion of the third embodiment of the valve opening-closing timing control apparatus in a locked state, which is a state in which the lock control valve portion is at a lock position.
Figure 21:
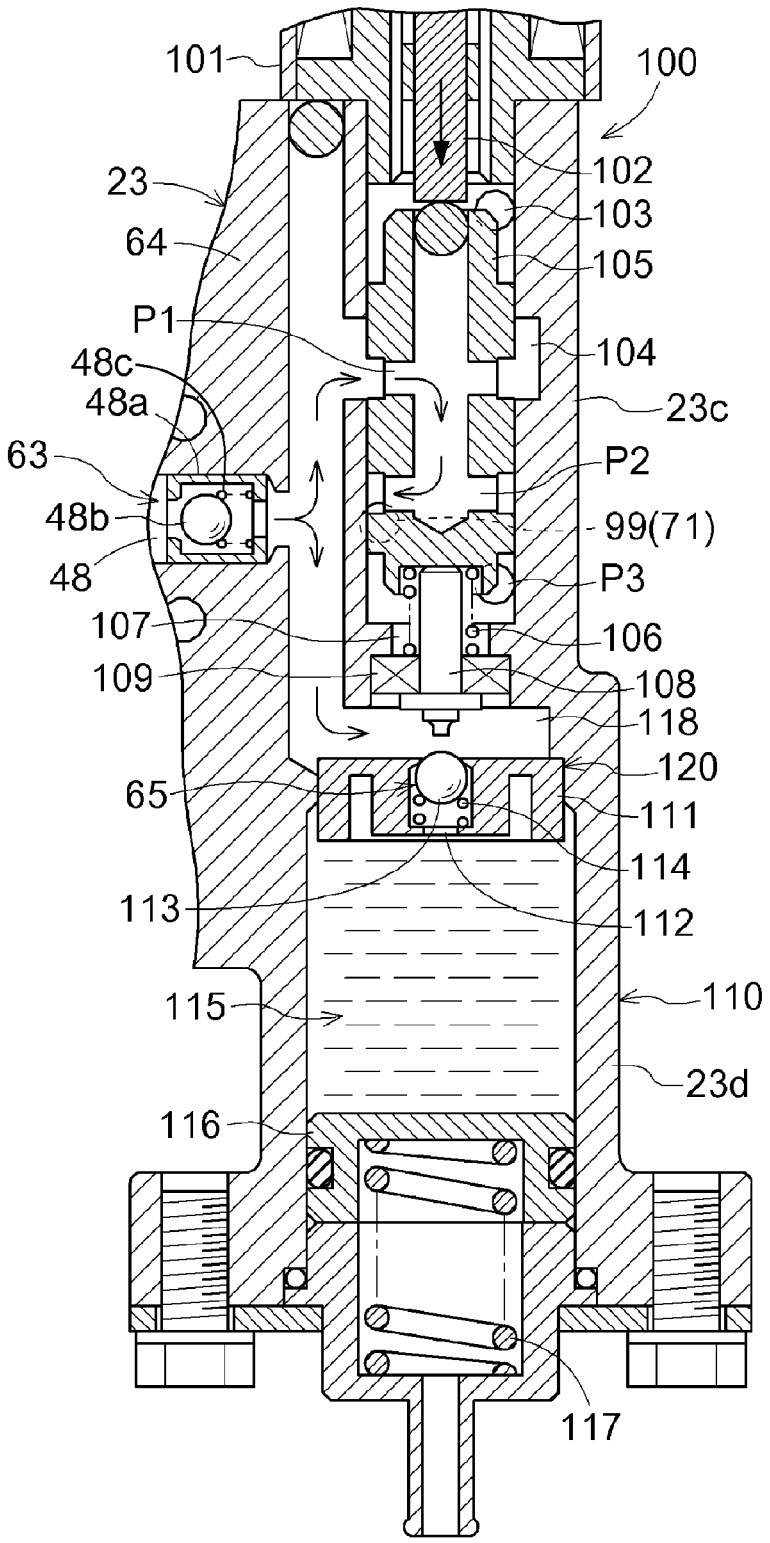
FIG. 21 is a cross-sectional view drawing illustrating the lock control valve portion of the third embodiment of the valve opening-closing timing control apparatus in an unlocked state, which is a state in which the lock control valve portion is at a normal unlock position.
Figure 22:
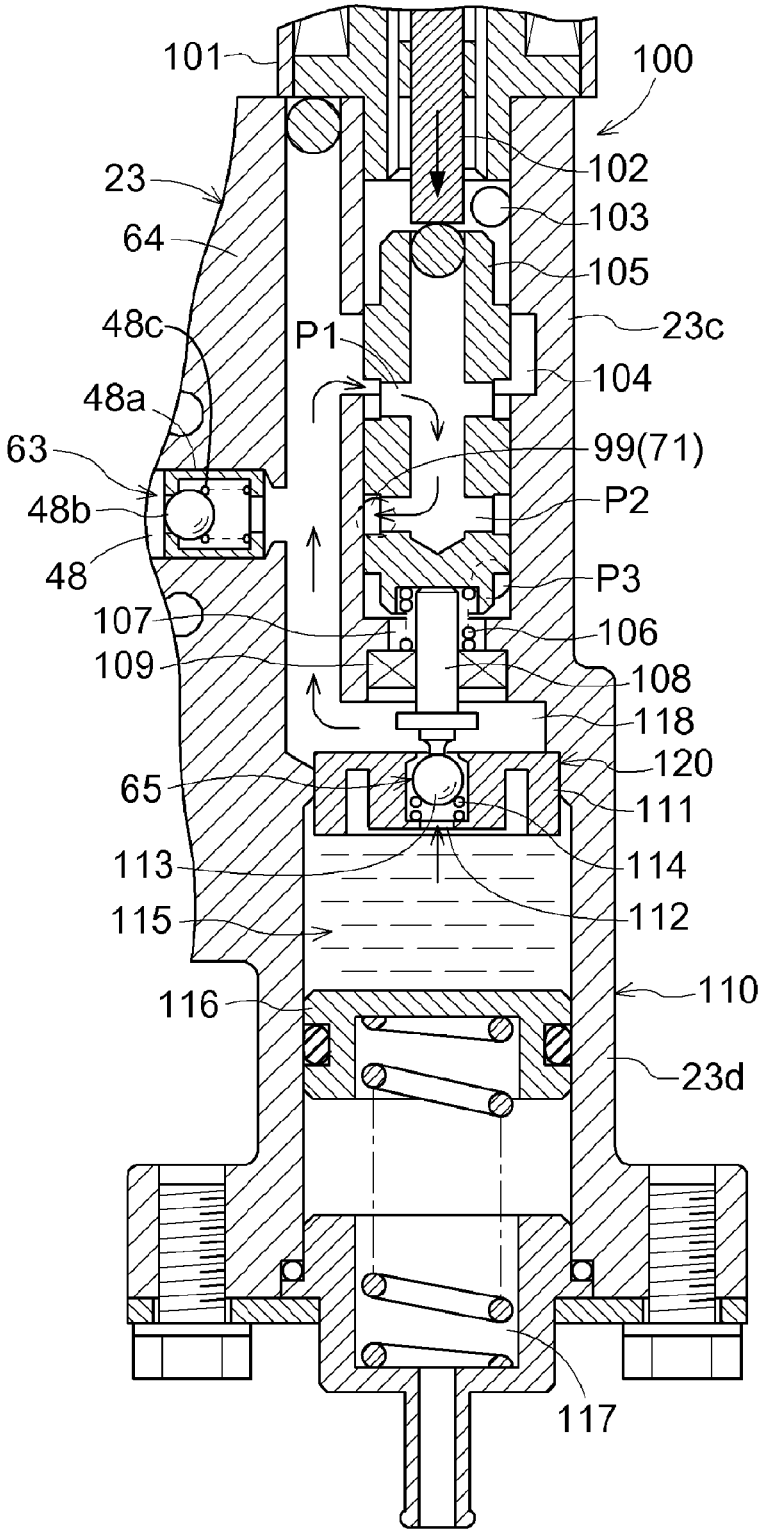
FIG. 22 is a cross-sectional view drawing illustrating the lock control valve portion of the third embodiment of the valve opening-closing timing control apparatus in the unlocked state, which is the state in which the lock control valve portion is at an unlock position at engine start.

Operations of the lock control valve portion 100, which serves as the lock control portion, will be described next referring to FIGS. 20 to 22. The lock control valve portion 100 is configured to switch a position of the spool 105 between a lock position, which is illustrated in FIG. 20, a normal unlock position, which is alternatively referred to as a duty position, which is illustrated in FIG. 21, and an unlock position at an engine start, which is illustrated in FIG. 22. The lock position refers to a position that switches the intermediate lock mechanism 9 and the most retarded angle lock mechanism 62 into the locked state. The normal unlock position refers to a position that switches the intermediate lock mechanism 9 and the most retarded angle lock mechanism 62 into the unlocked state at the time at which the engine E is started and during a period during which the engine E is driven. The unlock position at the engine start refers to a position that switches the intermediate lock mechanism 9 and the most retarded angle lock mechanism 62 into the unlocked state at the time at which the engine E is started.

FIG. 20 illustrates a state in which the spool 105 is switched to the lock position at the time at which the engine E is stopped. In this state, the solenoid 101 is not supplied with electricity and a position of the spool 105 is at a position closest to the solenoid 101.

At the lock position, the operation oil discharged from the oil pump P opens the second check valve 63 in a state where the hydraulic pressure is equal to or more than a predetermined hydraulic pressure so that the operation oil flows into the spool 105 through the inflow port P1 formed on the spool 105 from the supply-side passage 47 via the supply passage 48, however, communication between the outflow port P2, which is separately formed on the spool 105, and the lock passage 99 is cut off so that the operation oil does not flow into the lock passage 99. On the other hand, the lock passage 99 is communicated with the drain passage P3 so that the operation oil in the intermediate lock recess 93 and the most retarded angle lock recess 60 may be discharged through the drain passage P3 from the lock passage 99 via the intermediate lock passage 95 and the most retarded angle lock passage 61.

Accordingly, at the time at which the engine E is stopped, the first lock member 92*b* and the second lock member 92*a* are inserted into the intermediate lock recess 93 to switch the rotational phase of the inner rotor 5 relative to the outer rotor 3 to the locked state where the rotational phase is locked at the intermediate lock phase. A position of the spool 105 in this state is referred to as the intermediate lock position. In a state where hydraulic pressure of the operation oil discharged from the oil pump P has reached equal to or more than the predetermined hydraulic pressure, the second check valve 63 is opened so that the operation oil discharged from the oil pump P may be injected into the accumulator 110 via the supply passage 48.

FIG. 21 illustrates a state in which the spool 105 is switched to the normal unlock position during the period during which the engine E is driven. In this state, supply of electricity to the solenoid 101 is moderate and the spool 105 moves toward the accumulator 110 relative to the lock position, which is illustrated in FIG. 20.

At the normal unlock position, the inflow port P1 communicates with the lock passage 99 via the outflow port P2. The operation oil discharged from the oil pump P opens the second check valve 63 in a state where the hydraulic pressure of the operation oil is equal to or more than the predetermined hydraulic pressure. Accordingly, the operation oil flows from the supply passage 48 into inside of the spool 105 through the inflow port P1 so that the operation oil is supplied to the intermediate lock recess 93 and the most retarded angle lock recess 60 through the lock passage 99 via the outflow port P2.

As a result, the intermediate lock mechanism 9 and the most retarded angle lock mechanism 62 are switched to the unlocked state so that the rotational phase of the inner rotor 5 relative to the outer rotor 3 may be shifted to a selected rotational phase. In the normal unlock position also, the second check valve 63 opens in a state in which the hydraulic pressure of the operation oil discharged from the oil pump P is equal to or more than the predetermined hydraulic pressure. Accordingly, the operation oil discharged from the oil pump P is in a state in which the operation oil may be injected into the accumulator 110 via the supply passage 48.

FIG. 22 illustrates a state in which the spool 105 is switched to the unlock position at the engine start at a time immediately after the engine E is started. In this state, supply of electricity to the solenoid 101 is near maximum and the spool 105 has further moved toward the accumulator 110 relative to the normal unlock position, which is illustrated in FIG. 21.

At the unlock position at the engine start, the inflow port P1 communicate with the lock passage 99 via the outflow port P2. In addition, the push member 108 arranged at an end portion of the spool 105 pushes the spherical valve body 113 of the check valve 65 so that the accumulator control valve portion 120 is operated to open. In other words, the accumulator 110 is in an operational state when the spool 105 moves to the unlock position at the engine start. At this moment, the engine E is at a state immediately after the engine E is started. Accordingly, the second check valve 63 is retained in a closed state because the hydraulic pressure of the operation oil at the supply-side passage 47 is low.

When the accumulator control valve portion 120 is released to open, the operation oil in the accumulator 110 flows from an injection passage 118 into the hollow portion 104 to serve as the operation oil for lock release, which in turn flows into the lock passage 99 through the inflow port P1. Accordingly, in a state where the rotational phase is locked at the intermediate lock phase, the first lock member 92*b* and the second lock member 92*a* are switched into the unlocked state where the first lock member 92*b* and the second lock member 92*a* are retracted from the intermediate lock recess 93.

At a time of starting the engine E in a state where the rotational phase of the inner rotor 5 relative to the outer rotor 3 is locked at the intermediate lock phase, which is at a time at which the hydraulic pressure of the operation oil discharged from the oil pump P is not sufficient, which is illustrated in FIGS. 3 and 20, the lock control valve portion 100 switches the position of the spool 105 to the unlock position for the engine start, which is illustrated in FIG. 21, immediately after the engine E is started so that the accumulator 110 supplies the operational oil for lock release to the intermediate lock recess 93 to switch the state of the intermediate lock mechanism 9 into the unlocked state. Accordingly, the rotational phase of the inner rotor 5 may be shifted in the retarded angle direction S2, which is illustrated in FIGS. 4 and 5, by using the cam torque that is exerted on the camshaft 8.

Furthermore, by switching the spool 105 to the lock position, which is illustrated in FIG. 20, supply of the operation oil for lock release from the accumulator 110 to the intermediate lock recess 93 is stopped and the intermediate lock recess 93 is communicated with the drain passage P3 via the lock passage 99 so that the lock operation by the most retarded angle lock mechanism 62 is allowed. Accordingly, the rotational phase of the inner rotor 5 relative to the outer rotor 3 may be shifted to the most retarded angle phase by using a characteristic of a ratchet form provided in the ratchet mechanism 66 to stepwisely positioning the first lock member 92*b* into the most retarded angle lock recess 60. Note that, the most retarded angle phase is the phase at which the load on the engine E, which is an internal combustion engine, is reduced at the time at which the engine E is started by lowering the compression ratio of the intake air.

The valve opening-closing timing control apparatus 1 according to the third embodiment may be altered to a valve opening-closing timing control apparatus 1 configured with the lock control valve portion 100 of the second embodiment including the accumulator 110 in addition to the solenoid 101, the housing 23, and the spool 105. Such configuration may be described by replacing the descriptions of the most retarded angle lock mechanism 62 of the valve opening-closing timing control apparatus 1 according to the third embodiment with the most advanced angle lock mechanism 80, by replacing the descriptions of the most retarded angle lock recess 60 of the valve opening-closing timing control apparatus 1 according to the third embodiment with the most advanced angle lock recess 81, by replacing the descriptions of the most retarded angle lock passage 61 of the valve opening-closing timing control apparatus 1 according to the third embodiment with the most advanced angle lock passage 82, and by replacing the term "most retarded angle" in the descriptions of the valve opening-closing timing control apparatus 1 according to the third embodiment with the term "most advanced angle." Accordingly, descriptions in further details may be omitted. Other configurations are similar to those of the first embodiment.

The valve opening-closing timing control apparatus 1 according to this disclosure may be altered in following manners. Firstly, the housing 23 of the valve opening-closing timing control apparatus 1 according to this disclosure configured with the fluid control valve portion 2 and the lock control valve portion 100 may be integrally arranged on, for example, a front oil supply cover. Secondly, the accumulator 110 of the valve opening-closing timing control apparatus 1 according to this disclosure may be provided as a separate unit from the fluid control valve portion 2 and the lock control valve portion 100.

The valve opening-closing timing control apparatus 1 according to the first embodiment may be alternatively described as a following configuration. A valve opening-closing timing control apparatus 1 includes a driving-side rotational member (an outer rotor 3) synchronously rotating with a crankshaft E1 of an internal combustion engine (an engine E), a driven-side rotational member (an inner rotor 5) arranged to share a rotational axis X with the driving-side rotational member (the outer rotor 3) and integrally rotating with a camshaft 8 for opening and closing a valve of the internal combustion engine (the engine E), a partition portion (a vane 7) arranged on at least one of the driving-side rotational member (the outer rotor 3) and the driven-side rotational member (the inner rotor 5), the partition portion (the vane 7) partitioning a fluid pressure chamber 6 formed between the driving-side rotational member (the outer rotor 3) and the driven-side rotational member (the inner rotor 5) into an advanced angle chamber 6*a* and a retarded angle chamber 6*b*, a phase control portion (a fluid valve control portion 2) controlling a rotational phase of the driven-side rotational member (the inner rotor 5) relative to the driving-side rotational member (the outer rotor 3) by supplying and discharging a pressurized fluid to and from the advanced angle chamber 6*a* and the retarded angle chamber 6*b*, a lock mechanism (an intermediate lock mechanism 9, a most retarded angle lock mechanism 62) configured to lock the rotational phase at a predetermined phase, the lock mechanism (the intermediate lock mechanism 9, the most retarded angle lock mechanism 62) including a lock member (a second lock member 92*a*, a first lock member 92*b*) positioned at one of the driving-side rotational member (the outer rotor 3) and the driven-side rotational member (the inner rotor 5) and a lock recess (the most retarded angle lock recess 60, the intermediate lock recess 93) positioned at the other one of the driving-side rotational member (the outer rotor 3) and the driven-side rotational member (the inner rotor 5), the lock member (the second lock member 92*a*, the first lock member 92*b*) and the lock recess (the most retarded angle lock recess 60, the intermediate lock recess 93) engaging with each other when the lock member (the second lock member 92*a*, the first lock member 92*b*) is inserted into the lock recess (the most retarded angle lock recess 60, the intermediate lock recess 93) and disengaging with each other when the lock member (the second lock member 92*a*, the first lock member 92*b*) is retracted from the lock recess (the most retarded angle lock recess 60, the intermediate lock recess 93), and a lock control portion (a lock control valve portion 100) switching a state of the lock mechanism (the intermediate lock mechanism 9, the most retarded angle lock mechanism 62) between a locked state and an unlocked state by supplying and discharging a pressurized fluid to and from the lock recess (the most retarded angle lock recess 60, the intermediate lock recess 93). The lock mechanism (the intermediate lock mechanism 9, the most retarded angle lock mechanism 62) is configured to lock the rotational phase at the most retarded angle phase. The lock recess (the most retarded angle lock recess 60) formed at the most retarded angle phase position is formed stepwise and includes a lock recess portion (a most retarded angle lock recess portion 60*a*) and a guide recess portion 60*b*. The lock recess portion (the most retarded angle lock recess portion 60*a*) is a recess in which the lock member (the first lock member 92*b*) enters at a time at which the rotational phase reaches the most retarded angle phase. The guide recess portion 60*b* is recessed shallower than the lock recess portion (the most retarded angle lock recess portion 60*a*) in which the lock member (the first lock member 92*b*) may enter prior to the rotational phase reaching the most retarded angle phase. Upon the arrangement described herewith, the rotational phase of the driven-side rotational member (the inner rotor 5) relative to the driving side rotational member (the outer rotor 3) may be swiftly locked at the most retarded angle phase.

The valve opening-closing timing control apparatus 1 according to the second embodiment may be alternatively described as a following configuration. A valve opening-closing timing control apparatus 1 includes a driving-side rotational member (an outer rotor 3) synchronously rotating with a crankshaft E1 of an internal combustion engine (an engine E), a driven-side rotational member (an inner rotor 5) arranged to share a rotational axis X with the driving-side rotational member (the outer rotor 3) and integrally rotating with a camshaft 8 for opening and closing a valve of the internal combustion engine (the engine E), a partition portion (a vane 7) arranged on at least one of the driving-side rotational member (the outer rotor 3) and the driven-side rotational member (the inner rotor 5), the partition portion (the vane 7) partitioning a fluid pressure chamber 6 formed between the driving-side rotational member (the outer rotor 3) and the driven-side rotational member (the inner rotor 5) into an advanced angle chamber 6*a* and a retarded angle chamber 6*b*, a phase control portion (a fluid valve control portion 2) controlling a rotational phase of the driven-side rotational member (the inner rotor 5) relative to the driving-side rotational member (the outer rotor 3) by supplying and discharging a pressurized fluid to and from the advanced angle chamber 6*a* and the retarded angle chamber 6*b*, a lock mechanism (an intermediate lock mechanism 9, a most advanced angle lock mechanism 80) configured to lock the rotational phase at a predetermined phase, the lock mechanism (the intermediate lock mechanism 9, the most advanced angle lock mechanism 80) including a lock member (a second lock member 92*a*, a first lock member 92*b*) positioned at one of the driving-side rotational member (the outer rotor 3) and the driven-side rotational member (the inner rotor 5) and a lock recess (the most advanced angle lock recess 81, the intermediate lock recess 93) positioned at the other one of the driving-side rotational member (the outer rotor 3) and the driven-side rotational member (the inner rotor 5), the lock member (the second lock member 92*a*, the first lock member 92*b*) and the lock recess (the most advanced angle lock recess 81, the intermediate lock recess 93) engaging with each other when the lock member (the second lock member 92*a*, the first lock member 92*b*) is inserted into the lock recess (the most advanced angle lock recess 81, the intermediate lock recess 93) and disengaging with each other when the lock member (the second lock member 92*a*, the first lock member 92*b*) is retracted from the lock recess (the most advanced angle lock recess 81, the intermediate lock recess 93), and a lock control portion (a lock control valve portion 100) switching a state of the lock mechanism (the intermediate lock mechanism 9, the most advanced angle lock mechanism 80) between a locked state and an unlocked state by supplying and discharging a pressurized fluid to and from the lock recess (the most advanced angle lock recess 81, the intermediate lock recess 93). The lock mechanism (the intermediate lock mechanism 9, the most advanced angle lock mechanism 80) is configured to lock the rotational phase at the most advanced angle phase. The lock recess (the most advanced angle lock recess 81) at the most advanced angle phase position is formed stepwise and includes a lock recess portion (a most advanced angle lock recess portion 81*a*) and a guide recess portion 81*b*. The lock recess portion (the most advanced angle lock recess portion 81*a*) is a recess in which the lock member (the second lock member 92*a*) enters at a time at which the rotational phase reaches the most advanced angle phase. The guide recess portion 81*b* is recessed shallower than the lock recess portion (the most advanced angle lock recess portion 81*a*) in which the lock member (the second lock member 92*a*) may enter prior to the rotational phase reaching the most advanced angle phase. Upon the arrangement described herewith, the rotational phase of the driven-side rotational member (the inner rotor 5) relative to the driving side rotational member (the outer rotor 3) may be swiftly locked at the most advanced angle phase.

In addition, each of the above-described valve opening-closing timing control apparatus 1 according to the first embodiment and the second embodiment favorably includes a phase controlling supply passage 70, which supplies a pressurized fluid to the advanced angle chamber 6*a* and the retarded angle chamber 6*b*, and a lock controlling supply passage 71, which supplies a pressurized fluid to the lock recess (the most retarded angle lock recess 60, the most advanced angle lock recess 81, the intermediate lock recess 93), configured to separately supply the pressurized fluid.

Furthermore, the lock controlling supply passage 71 of each of the above-described valve opening-closing timing control apparatus 1 according to the first embodiment and the second embodiment favorably includes a one-way valve (the second check valve 63) blocking the pressurized fluid supplied to the lock controlling supply passage 71 from flowing into the phase controlling supply passage 70.

An industrial applicability of the valve opening-closing timing control apparatus 1 according to this disclosure will be described next. The valve opening-closing timing control apparatus 1 according to this disclosure is applicable to a valve opening-closing timing control apparatus for an internal combustion engine of, for example, an automobile.

According to an aspect of this disclosure, the valve opening-closing timing control apparatus 1 includes a driving-side rotational member (the outer rotor 3) synchronously rotating with a crankshaft E1 of an internal combustion engine (an engine E), a driven-side rotational member (the inner rotor 5) arranged to share a rotational axis X with the driving-side rotational member (the outer rotor 3) and integrally rotating with a camshaft 8 for opening and closing a valve of the internal combustion engine (the engine E), a partition portion (a vane 7) arranged on at least one of the driving-side rotational member (the outer rotor 3) and the driven-side rotational member (the inner rotor 5), the partition portion (the vane 7) partitioning a fluid pressure chamber 6 formed between the driving-side rotational member (the outer rotor 3) and the driven-side rotational member (the inner rotor 5) into an advanced angle chamber 6*a* and a retarded angle chamber 6*b*, a phase control portion (a fluid control valve portion 2) controlling a rotational phase of the driven-side rotational member (the inner rotor 5) relative to the driving-side rotational member (the outer rotor 3) by supplying and discharging a pressurized fluid to and from the advanced angle chamber 6*a* and the retarded angle chamber 6*b*, a lock mechanism (the intermediate lock mechanism 9, the most retarded angle lock mechanism 62, the most advanced angle lock mechanism 80) configured to lock the rotational phase at a predetermined phase, the lock mechanism (the intermediate lock mechanism 9, the most retarded angle lock mechanism 62, the most advanced angle lock mechanism 80) including a lock member (a second lock member 92*a*, a first lock member 92*b*) positioned at one of the driving-side rotational member (the outer rotor 3) and the driven-side rotational member (the inner rotor 5) and a lock recess (the most retarded angle lock recess 60, the most advanced angle lock recess 81, the intermediate lock recess 93) positioned at the other one of the driving-side rotational member (the outer rotor 3) and the driven-side rotational member (the inner rotor 5), the lock member (the second lock member 92*a*, the first lock member 92*b*) and the lock recess (the most retarded angle lock recess 60, the most advanced angle lock recess 81, the intermediate lock recess 93) engaging with each other when the lock member (the second lock member 92*a*, the first lock member 92*b*) is inserted into the lock recess (the most retarded angle lock recess 60, the most advanced angle lock recess 81, the intermediate lock recess 93) and disengaging with each other when the lock member (the second lock member 92*a*, the first lock member 92*b*) is retracted from the lock recess (the most retarded angle lock recess 60, the most advanced angle lock recess 81, the intermediate lock recess 93), a lock control portion (the lock control valve portion 100) switching a state of the lock mechanism (the intermediate lock mechanism 9, the most retarded angle lock mechanism 62, the most advanced angle lock mechanism 80) between a locked state and an unlocked state by supplying and discharging the pressurized fluid to and from the lock recess (the most retarded angle lock recess 60, the most advanced angle lock recess 81, the intermediate lock recess 93), a phase controlling supply passage 70 supplying the pressurized fluid to the advanced angle chamber 6*a* and the retarded angle chamber 6*b*, a lock controlling supply passage 71 supplying the pressurized fluid to the lock recess (the most retarded angle lock recess 60, the most advanced angle lock recess 81, the intermediate lock recess 93), and a one-way valve (the second check valve 63)

blocking the pressurized fluid supplied to the lock controlling supply passage 71 from flowing into the phase controlling supply passage 70.

The valve opening-closing timing control apparatus 1 according to this disclosure includes the one-way valve (the second check valve 63) blocking the pressurized fluid supplied to the lock controlling supply passage 71 from flowing into the phase controlling supply passage 70. Accordingly, when the rotational phase of the driven-side rotational member (the inner rotor 5) relative to the driving-side rotational member (the outer rotor 3) is attempted to shift while each of the advanced angle chamber 6*a* and the retarded angle chamber 6*b* is in a state where a pressurized fluid is discharged and while the lock mechanism (the intermediate lock mechanism 9, the most retarded angle lock mechanism 62, the most advanced angle lock mechanism 80) is retained in the unlocked state by supplying the pressurized fluid for lock release to the lock recess (the most retarded angle lock recess 60, the most advanced angle lock recess 81, the intermediate lock recess 93), falling of a fluid pressure of the pressurized fluid for lock release may be prevented during a period during which the pressurized fluid for phase change is supplied to either the advanced angle chamber 6*a* or the retarded angle chamber 6*b* to shift the rotational phase, which is a period during which a fluid pressure of the pressurized fluid for phase change falls until the fluid pressure of the pressurized fluid for phase change rises to a predetermined pressure. Accordingly, the lock member (the second lock member 92*a*, the first lock member 92*b*) retracted from the lock recess (the most retarded angle lock recess 60, the most advanced angle lock recess 81, the intermediate lock recess 93) is less likely to engage again with the lock recess (the most retarded angle lock recess 60, the most advanced angle lock recess 81, the intermediate lock recess 93) so that the rotational phase may be smoothly changed while retaining the lock mechanism (the intermediate lock mechanism 9, the most retarded angle lock mechanism 62, the most advanced angle lock mechanism 80) in the unlocked state.

According to another aspect of this disclosure, the valve opening-closing timing control apparatus 1 further includes a fluid pump (the oil pump P) discharging the pressurized fluid, the phase control portion (the fluid control valve portion 2) supplying the pressurized fluid discharged from the fluid pump (the oil pump P) to the advanced angle chamber 6*a* or the retarded angle chamber 6*b*, and the lock control portion (the lock control valve portion 100) supplying the pressurized fluid discharged from the fluid pump (the oil pump P) to the lock recess (the most retarded angle lock recess 60, the most advanced angle lock recess 81, the intermediate lock recess 93).

Upon the arrangement described herewith, the pressurized fluid discharged from a common fluid pump (the oil pump P) may be supplied to either the advanced angle chamber 6*a* or the retarded angle chamber 6*b* and to the lock recess (the most retarded angle lock recess 60, the most advanced angle lock recess 81, the intermediate lock recess 93) so that structure of the valve opening-closing timing control apparatus 1 may be simplified.

According to further aspect of this disclosure, the valve opening-closing timing control apparatus 1 further includes a fluid pump (the oil pump P) discharging the pressurized fluid, an accumulator 110 for storing the pressurized fluid discharged from the fluid pump (the oil pump P), the accumulator 110 supplying the pressurized fluid for lock release to the lock controlling supply passage 71 at a time of starting the internal combustion engine (the engine E), the phase control portion (the fluid control valve portion 2) supplying the pressurized fluid discharged from the fluid pump (the oil pump P) to the advanced angle chamber 6*a* or to the retarded angle chamber 6*b*, and the one-way valve (the second check valve 63) for blocking the pressurized fluid discharged from the accumulator 110 from flowing into the phase controlling supply passage 70 when the accumulator 110 supplies the pressurized fluid for lock release to the lock controlling supply passage 71.

In general, in a case where a valve opening-closing timing control apparatus includes an intermediate lock mechanism, the internal combustion engine (the engine E) is started in a state where the driven-side rotational member (the inner rotor 5) is retained at an intermediate lock phase. When the internal combustion engine (the engine E) is started, the driven-side rotational member (the inner rotor 5) is controlled to shift toward the most retarded angle phase, which is an appropriate phase for an idling state. Furthermore, normally, an anti-torque of cams is exerted on the driven-side rotational member (the inner rotor 5) via the camshaft 8. Accordingly, the driven-side rotational member (the inner rotor 5) is likely to change phase in a retarded angle direction relative to the driving-side rotational member (the outer rotor 3). In order to efficiently start the internal combustion engine (the engine E) by utilizing the above-described characteristics of the valve opening-closing timing control apparatus 1, the valve opening-closing timing control apparatus 1 according to this disclosure is equipped with the accumulator 110 to release the driven-side rotational member (the inner rotor 5) from the locked state. The accumulator 110 is configured to store the pressurized fluid discharged from the fluid pump (the oil pump P) to supply the pressurized fluid for lock release to the lock control portion (the lock control valve portion 100) at a time at which the internal combustion engine (the engine E) is started. Furthermore, the valve opening-closing timing control apparatus 1 according to this disclosure includes the one-way valve (the second check valve 63) that blocks a pressurized fluid that is discharged from the accumulator 110 from flowing into the phase controlling supply passage 70 at a time at which the accumulator 110 supplies the pressurized fluid for lock release to the lock controlling supply passage 71 in order to block the pressurized fluid that is discharged from the accumulator 110 from flowing in a direction of the phase control portion (the fluid control valve portion 2) and in a direction of the fluid pump (the oil pump P). More specifically, at the time at which the internal combustion engine (the engine E) is started, the pressurized fluid that is discharged from the accumulator 110 is entirely supplied to the lock control portion (the lock control valve portion 100). The supply of the pressurized fluid to the lock control portion (the lock control valve portion 100) releases the valve opening-closing timing control apparatus 1 from an intermediate phase lock state. At this moment, the pressurized fluid for phase control is not yet sufficiently filled in the retarded angle chamber 6*b* and the advanced angle chamber 6*a*. Accordingly, the driven-side rotational member (the inner rotor 5) moves to a phase in the retarded angle direction by the anti-torque of the cams exerted on the driven-side rotational member (the inner rotor 5). In other words, the driven-side rotational member (the inner rotor 5) shifts to a state, for example, appropriate for idling. Accordingly, volume of the accumulator 110 is defined to minimum for releasing the lock mechanism (the intermediate lock mechanism 9, the most retarded angle lock mechanism 62, the most advanced angle lock mechanism 80) from the locked state and by supplying the pressurized fluid discharged from the accumulator 110 to the lock control portion (the lock control valve portion 100), the valve opening-closing timing control apparatus 1 may be provided with size of the accumulator 110 made to small. Simultaneously, the valve opening-closing timing control apparatus 1 may be provided with favorable start characteristic of the internal combustion engine (the engine E).

According to another aspect of this disclosure, the phase control portion (the fluid control valve portion 2) and the lock control portion (the lock control valve portion 100) of the valve opening-closing timing control apparatus 1 are integrally arranged in a state where the phase control portion (the fluid control valve portion 2) and the lock control portion (the lock control valve portion 100) are arranged adjacent to each other. The phase control portion (the fluid control valve portion 2) and the lock control portion (the lock control valve portion 100) are provided with a supply passage 48 extending through a separation portion 64 formed between the phase control portion (the fluid control valve portion 2) and the lock control portion (the lock control valve portion 100), the supply passage 48 supplying the pressurized fluid discharged from the fluid pump (the oil pump P) to the lock controlling supply passage 71 via the phase controlling supply passage 70. Furthermore, the one-way valve (the second check valve 63) is arranged on the supply passage 48.

By integrally arranging the phase control portion (the fluid control valve portion 2) and the lock control portion (the lock control valve portion 100), size of the phase control portion (the fluid control valve portion 2) and the lock control portion (the lock control valve portion 100) as a whole may be made to small. Furthermore, the phase control portion (the fluid control valve portion 2) and the lock control portion (the lock control valve portion 100) may be installed to the internal combustion engine (the engine E) simultaneously so that installment procedure may be easier relative to a case where the phase control portion (the fluid control valve portion 2) and the lock control portion (the lock control valve portion 100) are separately provided. In addition, by arranging the one-way valve (the second check valve 63) on the supply passage 48 that extends through the separation portion 64 that is formed between the phase control portion (the fluid control valve portion 2) and the lock control portion (the lock control valve portion 100), the phase control portion (the fluid control valve portion 2) and the lock control portion (the lock control valve portion 100) may be compactly arranged.

According to further aspect of this disclosure, the lock control portion (the lock control valve portion 100) of the valve opening-closing timing control apparatus 1 is provided with a configuration where the accumulator 110 supplies the pressurized fluid for lock release to the lock recess (the most retarded angle lock recess 60, the most advanced angle lock recess 81, the intermediate lock recess 93) and when the state of the lock mechanism (the intermediate lock mechanism 9, the most retarded angle lock mechanism 62, the most advanced angle lock mechanism 80) switches to the unlocked state, the accumulator 110 stops supply of the pressurized fluid for lock release to the lock recess (the most retarded angle lock recess 60, the most advanced angle lock recess 81, the intermediate lock recess 93) and the lock recess (the most retarded angle lock recess 60, the most advanced angle lock recess 81, the intermediate lock recess 93) communicates with a drain passage P3.

The pressurized fluid that is stored in the accumulator 110 may be used for unlocking the intermediate lock mechanism 9 at the time at which the internal combustion engine (the engine E) is started. Upon the arrangement described herewith, supply of the pressurized fluid to the lock recess may be immediately stopped after the lock member (the second lock member 92*a*, the first lock member 92*b*) is made to retract from the lock recess (the most retarded angle lock recess 60, the most advanced angle lock recess 81, the intermediate lock recess 93). Accordingly, an amount of the pressurized fluid for lock release may be made to small amount. Likewise, the volume of the accumulator 110 may be made to small volume.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve opening-closing timing control apparatus, comprising:

a driving-side rotational member synchronously rotating with a crankshaft of an internal combustion engine;

a driven-side rotational member arranged to share a rotational axis with the driving-side rotational member and integrally rotating with a camshaft for opening and closing a valve of the internal combustion engine;

a partition portion arranged on at least one of the driving-side rotational member and the driven-side rotational member, the partition portion partitioning a fluid pressure chamber formed between the driving-side rotational member and the driven-side rotational member into an advanced angle chamber and a retarded angle chamber;

a phase control portion controlling a rotational phase of the driven-side rotational member relative to the driving-side rotational member by supplying and discharging a pressurized fluid to and from the advanced angle chamber and the retarded angle chamber;

a lock mechanism configured to lock the rotational phase at a predetermined phase, the lock mechanism including a lock member positioned at one of the driving-side rotational member and the driven-side rotational member and a lock recess positioned at the other one of the driving-side rotational member and the driven-side rotational member, the lock member and the lock recess engaging with each other when the lock member is inserted into the lock recess and disengaging with each other when the lock member is retracted from the lock recess;

a lock control portion switching a state of the lock mechanism between a locked state and an unlocked state by supplying and discharging the pressurized fluid to and from the lock recess;

a phase controlling supply passage supplying the pressurized fluid to the advanced angle chamber and the retarded angle chamber;

a lock controlling supply passage supplying the pressurized fluid to the lock recess; and a one-way valve blocking the pressurized fluid supplied to the lock controlling supply passage from flowing into the phase controlling supply passage.

2. The valve opening-closing timing control apparatus according to claim 1 further comprising:

a fluid pump discharging the pressurized fluid;

the phase control portion supplying the pressurized fluid discharged from the fluid pump to the advanced angle chamber or the retarded angle chamber; and the lock control portion supplying the pressurized fluid discharged from the fluid pump to the lock recess.

3. The valve opening-closing timing control apparatus according to claim 1 further comprising:

a fluid pump discharging the pressurized fluid;

an accumulator for storing the pressurized fluid discharged from the fluid pump, the accumulator supplying the pressurized fluid for lock release to the lock controlling supply passage at a time of starting the internal combustion engine;

the phase control portion supplying the pressurized fluid discharged from the fluid pump to the advanced angle chamber or to the retarded angle chamber; and the one-way valve for blocking the pressurized fluid discharged from the accumulator from flowing into the phase controlling supply passage when the accumulator supplies the pressurized fluid for lock release to the lock controlling supply passage.

4. The valve opening-closing timing control apparatus according to claim 2, wherein the phase control portion and the lock control portion are integrally arranged in a state where the phase control portion and the lock control portion are arranged adjacent to each other, wherein the phase control portion and the lock control portion are provided with a supply passage extending through a separation portion formed between the phase control portion and the lock control portion, the supply passage supplying the pressurized fluid discharged from the fluid pump to the lock controlling supply passage via the phase controlling supply passage, and wherein the one-way valve is arranged on the supply passage.

5. The valve opening-closing timing control apparatus according to claim 3, wherein the phase control portion and the lock control portion are integrally arranged in a state where the phase control portion and the lock control portion are arranged adjacent to each other, wherein the phase control portion and the lock control portion are provided with a supply passage extending through a separating portion formed between the phase control portion and the lock control portion, the supply passage supplying the pressurized fluid discharged from the fluid pump to the lock controlling supply passage via the phase controlling supply passage, and wherein the one-way valve is arranged on the supply passage.

6. The valve opening-closing timing control apparatus according to claim 3, wherein the lock control portion is provided with a configuration where the accumulator supplies the pressurized fluid for lock release to the lock recess and when the state of the lock mechanism switches to the unlocked state, the accumulator stops supply of the pressurized fluid for lock release to the lock recess and the lock recess communicates with a drain passage.

* * * * *